US011657768B2

(12) United States Patent
Kim et al.

(10) Patent No.: US 11,657,768 B2
(45) Date of Patent: May 23, 2023

(54) DISPLAY DEVICE

(71) Applicant: Samsung Display Co., LTD., Yongin-si (KR)

(72) Inventors: Soo Yeon Kim, Namyangju-si (KR); Tae Gon Im, Seongnam-si (KR); Jong Jae Lee, Hwaseong-si (KR); Jun Pyo Lee, Asan-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/670,621

(22) Filed: Feb. 14, 2022

(65) Prior Publication Data

US 2022/0375414 A1 Nov. 24, 2022

(30) Foreign Application Priority Data

May 24, 2021 (KR) ..... 10-2021-0065942

(51) Int. Cl.
*G09G 3/3275* (2016.01)
*G09G 3/3233* (2016.01)

(52) U.S. Cl.
CPC ..... *G09G 3/3275* (2013.01); *G09G 3/3233* (2013.01); *G09G 2300/0819* (2013.01); *G09G 2300/0842* (2013.01); *G09G 2310/08* (2013.01); *G09G 2320/0233* (2013.01); *G09G 2320/0295* (2013.01); *G09G 2320/045* (2013.01); *G09G 2340/0435* (2013.01)

(58) Field of Classification Search
CPC ..... G09G 3/32–3291; G09G 2300/08–0876; G09G 2320/103; G09G 2320/029–0295; G09G 2320/045; G09G 2340/0435
See application file for complete search history.

(56) References Cited

U.S. PATENT DOCUMENTS

| | | | | |
|---|---|---|---|---|
| 10,403,203 | B2 * | 9/2019 | Kim | G09G 3/3233 |
| 10,460,666 | B2 * | 10/2019 | Kim | G09G 3/3266 |
| 10,748,490 | B2 * | 8/2020 | Xu | G09G 3/3258 |
| 11,004,402 | B2 * | 5/2021 | Ji | G09G 3/3291 |
| 11,288,997 | B1 * | 3/2022 | Im | G09G 3/3275 |
| 11,341,892 | B2 * | 5/2022 | Nomura | G09G 3/3685 |

(Continued)

FOREIGN PATENT DOCUMENTS

| | | |
|---|---|---|
| KR | 10-2010-0072645 | 7/2010 |
| KR | 10-2020-0072228 | 6/2020 |
| KR | 10-2020-0091062 | 7/2020 |

*Primary Examiner* — Patrick F Marinelli
(74) *Attorney, Agent, or Firm* — Kile Park Reed & Houtteman PLLC

(57) ABSTRACT

A display device includes a display panel including a pixel including a light emitting element emitting light and electrically connected to a data line and a sensing line, a timing controller varying a driving frequency of the display panel based on an input frequency of digital video data, and a data driver supplying a data voltage to the data line based on the digital video data during a data addressing period of a frame period and receiving a sensing signal from the sensing line during a sensing period. The data driver electrically connects the sensing line to an initialization voltage line during the data addressing period in case that the digital video data is changed, and electrically connects the sensing line to a high impedance during the data addressing period in case that the digital video data is not changed.

20 Claims, 23 Drawing Sheets

(56) References Cited

U.S. PATENT DOCUMENTS

| | | | | |
|---|---|---|---|---|
| 2013/0050292 | A1* | 2/2013 | Mizukoshi | G09G 3/3233 345/77 |
| 2018/0190198 | A1* | 7/2018 | Kim | G09G 3/3233 |
| 2020/0013340 | A1* | 1/2020 | Kim | G09G 3/3233 |
| 2020/0074927 | A1* | 3/2020 | Xu | G09G 3/3233 |
| 2020/0312249 | A1* | 10/2020 | Ji | G09G 3/3275 |
| 2022/0173199 | A1* | 6/2022 | Yamamoto | H01L 27/3265 |
| 2022/0189356 | A1* | 6/2022 | Hong | G09G 3/3233 |

* cited by examiner

DISPLAY DEVICE

CROSS-REFERENCE TO RELATED APPLICATION(S)

This application claims priority to and the benefit of Korean Patent Application No. 10-2021-0065942 under 35 U.S.C. § 119, filed on May 24, 2021, in the Korean Intellectual Property Office (KIPO), the entire contents of which are incorporated herein by reference.

BACKGROUND

1. Technical Field

The disclosure relates to a display device.

2. Description of the Related Art

With the advance of information-oriented society, more and more demands are placed on display devices for displaying images in various ways. For example, display devices are employed in various electronic devices such as smartphones, digital cameras, laptop computers, navigation devices, and smart televisions. In the display device, since each of pixels of a display panel includes a light emitting element capable of emitting light by itself, an image can be displayed without a backlight unit providing light to the display panel.

The display device may receive digital video data in a variable frequency method during quick screen switching. In the display device, a difference may occur in a blank period according to a frequency. For example, as the frequency is lower, the blank period of the display device may be longer. Accordingly, a difference may occur between the luminance of the image displayed by the low frequency and the luminance of the image displayed by the high frequency.

SUMMARY

Aspects of the disclosure provide a display device capable of improving a luminance difference between driving frequencies in case that frequency variable driving is performed.

However, aspects of the disclosure are not restricted to the one set forth herein. The above and other aspects of the disclosure will become more apparent to one of ordinary skill in the art to which the disclosure pertains by referencing the detailed description of the disclosure given below.

According to an embodiment of the disclosure, a display device may include a display panel including a pixel including a light emitting element emitting light and electrically connected to a data line and a sensing line, a timing controller varying a driving frequency of the display panel based on an input frequency of digital video data, and a data driver supplying a data voltage to the data line based on the digital video data during a data addressing period of a frame period and receiving a sensing signal from the sensing line during a sensing period. The data driver may electrically connect the sensing line to an initialization voltage line during the data addressing period in case that the digital video data is changed, and electrically connect the sensing line to a high impedance during the data addressing period in case that the digital video data is not changed.

The pixel may emit light during a blanking period immediately after the data addressing period of the frame period, and a length of the data addressing period may be maintained and a length of the blanking period may be changed in case that the driving frequency is changed.

The data driver may drive the pixel during a first frame period of being driven at a first driving frequency and a second frame period of being driven at a second driving frequency smaller than the first driving frequency. The second driving frequency may be smaller than the first driving frequency. A length of a blanking period of the first frame period may be shorter than a length of a blanking period of the second frame period.

The pixel may comprise a first transistor disposed between a driving voltage line and the light emitting element to supply a driving current to the light emitting element, a second transistor connecting the data line to a first node that is a gate electrode of the first transistor based on a first gate signal, and a third transistor connecting the sensing line to a second node that is a source electrode of the first transistor based on a second gate signal.

The data driver may supply a data voltage to the second transistor during the data addressing period.

The third transistor may be turned off during the data addressing period in case that the digital video data is not changed.

A gate electrode of the third transistor may receive a second gate signal of a gate-on voltage during the data addressing period in case that the digital video data is not changed, and a source electrode of the third transistor may be electrically connected to a high impedance through the sensing line.

The data driver may include an analog-to-digital converter converting the sensing signal into digital data, a first switching element electrically connecting the sensing line to the high impedance or the initialization voltage line based on a first switching signal, and a second switching element electrically connecting the sensing line to the analog-to-digital converter based on a second switching signal.

The timing controller may supply a first switching signal having a bit value to electrically connect the sensing line to the initialization voltage line, to the first switching element during the data addressing period in case that the digital video data is changed.

The timing controller may supply a first switching signal having a bit value to connect the sensing line to the high impedance, to the first switching element during the data addressing period in case that the digital video data is not changed.

The data driver may include an analog-to-digital converter converting the sensing signal into digital data, a first switching element electrically connecting the sensing line to the high impedance based on a first switching signal, a second switching element electrically connecting the sensing line to the initialization voltage line based on a second switching signal, and a third switching element electrically connecting the sensing line to the analog-to-digital converter based on a third switching signal.

The timing controller may supply a first switching signal of a high level to the first switching element during the data addressing period in case that the digital video data is not changed.

The timing controller may supply a second switching signal of a high level to the second switching element during the data addressing period in case that the digital video data is changed.

According to an embodiment of the disclosure, a display device may include a display panel including a pixel including a light emitting element emitting light and electrically connected to a data line and a sensing line, a timing controller varying a driving frequency of the display panel based on an input frequency of digital video data, and a data driver supplying a data voltage to the data line based on the digital video data and receiving a sensing signal from the sensing line. The pixel may include a first transistor disposed between a driving voltage line and the light emitting element and supplying a driving current to the light emitting element, a second transistor electrically connecting the data line to a first node that is a gate electrode of the first transistor based on a first gate signal, and a third transistor electrically connecting a second node that is a source electrode of the first transistor to a third node that is the sensing line based on a second gate signal. The data driver electrically connects the sensing line to an initialization voltage line in case that the digital video data is changed, and electrically connects a high impedance to the third node in case that the digital video data is not changed.

The data driver may supply a data voltage to the second transistor during a data addressing period of a frame period. The third transistor may be turned off during the data addressing period in case that the digital video data is not changed.

A gate electrode of the third transistor may receive a second gate signal of a gate-on voltage during the data addressing period in case that the digital video data is not changed. A source electrode of the third transistor may be electrically connected to a high impedance through the sensing line.

The data driver may comprise an analog-to-digital converter converting the sensing signal into digital data, a first switching element electrically connecting the sensing line to the high impedance or the initialization voltage line based on a first switching signal, and a second switching element electrically connecting the sensing line to the analog-to-digital converter based on a second switching signal.

The timing controller may supply a first switching signal having a bit value to electrically connect the sensing line to the initialization voltage line to the first switching element in case that the digital video data is changed. The timing controller may supply a first switching signal having a bit value to electrically connect the sensing line to the high impedance to the first switching element in case that the digital video data is not changed.

The data driver may comprise an analog-to-digital converter converting the sensing signal into digital data, a first switching element electrically connecting the sensing line to the high impedance based on a first switching signal, a second switching element electrically connecting the sensing line to the initialization voltage line based on a second switching signal, and a third switching element electrically connecting the sensing line to the analog-to-digital converter based on a third switching signal.

The timing controller may supply a first switching signal of a high level to the first switching element in case that the digital video data is not changed. The timing controller may supply a second switching signal of a high level to the second switching element in case that the digital video data is changed.

According to the display device according to the embodiments, in case that digital video data is not changed, the sensing line may be electrically connected to a high impedance in the data addressing period. In this case, the gate electrode of the transistor between the first electrode of the light emitting element and the sensing line may receive a gate signal of a high level, but the source electrode of the transistor may be electrically connected to a high impedance, so that the transistor may be turned off, and the voltage of the first electrode of the light emitting element may be stably maintained. Accordingly, in case that the display device performs frequency variable driving without changing the digital video data, the luminance reset in the data addressing period may be omitted and the luminance difference between the driving frequencies may be improved.

However, the effects of the disclosure are not limited to the aforementioned effects, and various other effects are included in the specification.

BRIEF DESCRIPTION OF THE DRAWINGS

The above and other aspects and features of the disclosure will become more apparent by describing in detail embodiments thereof with reference to the attached drawings, in which.

DETAILED DESCRIPTION OF THE EMBODIMENTS

Figure 1:
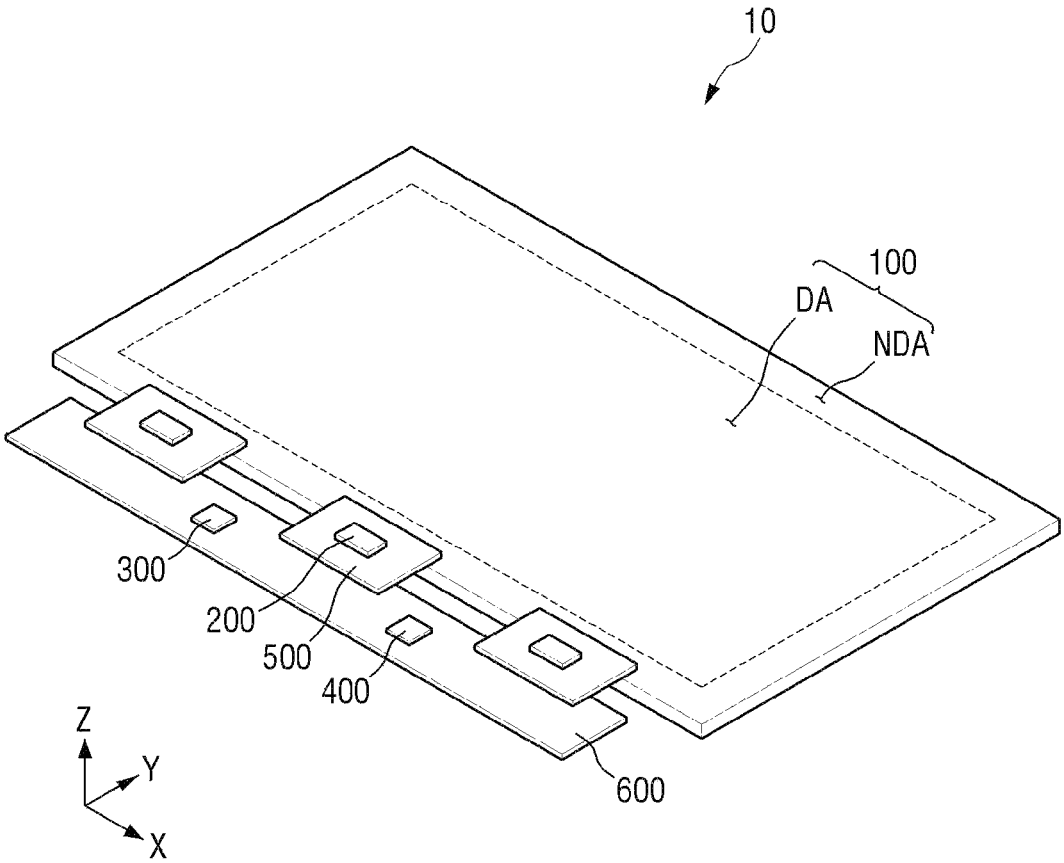
FIG. 1 is a schematic perspective view showing a display device according to an embodiment.

In the following description, for the purposes of explanation, numerous specific details are set forth in order to provide a thorough understanding of various embodiments or implementations of the disclosure. As used herein "embodiments" and "implementations" are interchangeable words that are non-limiting examples of devices or methods employing one or more of the disclosure disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in other embodiments without departing from the disclosure.

Unless otherwise specified, the illustrated embodiments are to be understood as providing features of varying detail of some ways in which the disclosure may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the disclosure.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified.

Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements.

It will be understood that the terms "contact," "connected to," and "coupled to" may include a physical and/or electrical contact, connection, or coupling.

Further, the X-axis, the Y-axis, and the Z-axis are not limited to three axes of a rectangular coordinate system, and thus the X-, Y-, and Z-axes, and may be interpreted in a broader sense. For example, the X-axis, the Y-axis, and the Z-axis may be perpendicular to one another, or may represent different directions that are not perpendicular to one another.

For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," and the like may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein should be interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation, not as terms of degree, and thus are utilized to account for inherent deviations in measured, calculated, and/or provided values that would be recognized by one of ordinary skill in the art.

Various embodiments are described herein with reference to sectional and/or exploded illustrations that are schematic illustrations of idealized embodiments and/or intermediate structures. As such, variations from the shapes of the illustrations as a result, for example, of manufacturing techniques and/or tolerances, are to be expected. Thus, embodiments disclosed herein should not necessarily be construed as limited to the particular illustrated shapes of regions, but are to include deviations in shapes that result from, for instance, manufacturing. In this manner, regions illustrated in the drawings may be schematic in nature, and the shapes of these regions may not reflect actual shapes of regions of a device and are not necessarily intended to be limiting.

As customary in the field, some embodiments are described and illustrated in the accompanying drawings in terms of functional blocks, units, parts, and/or modules. Those skilled in the art will appreciate that these blocks, units, parts, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, parts, and/or modules being implemented by microprocessors or other similar hardware, they may be programmed and controlled using software (e.g., microcode) to perform various functions discussed herein and may optionally be driven by firmware and/or software. It is also contemplated that each block, unit, part, and/or module may be implemented by dedicated hardware, or as a combination of dedicated hardware to perform some functions and a processor (e.g., one or more programmed microprocessors and associated circuitry) to perform other functions. Also, each block, unit, part, and/or module of some embodiments may be physically separated into two or more interacting and discrete blocks, units, parts, and/or modules without departing from the scope of the disclosure. Further, the blocks, units, parts, and/or modules of some embodiments may be physically combined into more complex blocks, units, parts, and/or modules without departing from the scope of the disclosure.

Unless otherwise defined or implied herein, all terms (including technical and scientific terms) used herein have the same meaning as commonly understood by one of ordinary skill in the art to which this disclosure pertains. It will be further understood that terms, such as those defined in commonly used dictionaries, should be interpreted as having a meaning that is consistent with their meaning in the context of the relevant art and the disclosure, and should not be interpreted in an ideal or overly formal sense, unless clearly so defined herein.

FIG. 1 is a schematic perspective view showing a display device according to an embodiment.

Referring to FIG. 1, a display device 10 is a device for displaying a moving image or a still image. The display device 10 may be used as a display screen of various devices, such as a television, a laptop computer, a monitor, a billboard, and an Internet of things (IoT) device, as well as portable electronic devices such as a mobile phone, a smartphone, a tablet personal computer (PC), a smartwatch, a watch phone, a mobile communication terminal, an electronic notebook, an e-book reader, a portable multimedia player (PMP), a navigation device, and an ultra-mobile PC (UMPC).

The display device 10 may include a display panel 100, a data driver 200, a timing controller 300, a power supply unit 400, a data circuit board 500, and a control circuit board 600.

The display panel 100 may be formed in a rectangular shape, in a plan view, having long sides in a first direction (e.g., X-axis direction) and short sides in a second direction (e.g., Y-axis direction) intersecting the first direction (e.g., X-axis direction). The corner where the long side in the first direction (e.g., X-axis direction) and the short side in the second direction (e.g., Y-axis direction) meet may be rounded to have a predetermined curvature or may be right-angled. The planar shape of the display panel 100 is not limited to the rectangular shape, and may be formed in a polygonal shape, a circular shape, or an elliptical shape. The display panel 100 may be formed to be flat, but the disclosure is not limited thereto. For example, the display panel 100 may include a curved portion formed at left and right ends thereof and having a predetermined curvature or a varying curvature. The display panel 100 may be formed flexibly such that it can be curved, bent, folded, or rolled.

The display panel 100 may include a display area DA displaying an image and a non-display area NDA disposed around the display area DA. The display area DA may occupy most of the area of the display panel 100. The display area DA may be disposed at the center of the display panel 100. The display area DA may include pixels displaying an image.

Each of the pixels may include a light emitting element that emits light. The light emitting element may include at least one of an organic light emitting diode including an organic light emitting layer, a quantum dot light emitting diode including a quantum dot light emitting layer, an inorganic light emitting diode including an inorganic semiconductor, or a micro light emitting diode (micro LED), but the disclosure is not limited thereto.

The non-display area NDA may be disposed adjacent to the display area DA. The non-display area NDA may be an area outside the display area DA. The non-display area NDA may be disposed to surround the display area DA. The non-display area NDA may be an edge area of the display area DA.

The non-display area NDA may include a gate driver, fan-out lines, and a pad portion. The gate driver may supply a gate signal to the gate lines of the display area DA. The fan-out lines may electrically connect the data driver 200 and the data lines of the display area DA. The pad portion may be electrically connected to the data circuit board 500. For example, the pad portion may be disposed on the edge on a side of the display panel 100, and the gate driver may be disposed on the edge on another side adjacent to the edge on the side of the display panel 100, but the disclosure is not limited thereto.

The data driver 200 may output signals and voltages for driving the display panel 100. The data driver 200 may supply a data voltage to data lines. The data driver 200 may supply a power voltage to power lines and may supply a gate control signal to the gate driver. The data driver 200 may be formed of an integrated circuit (IC) and mounted on a data circuit board 500 by a chip on film (COF) method. As another example, the data driver 200 may be mounted in the non-display area NDA of the display panel 100 by a chip on glass (COG) method, a chip on plastic (COP) method, or an ultrasonic bonding method.

The timing controller 300 may be mounted on the control circuit board 600 and may receive (or may be supplied with) digital video data and a timing synchronization signal supplied from a display driving system or a graphic device through a user connector provided on the control circuit board 600. The timing controller 300 may align digital video data to suit a pixel arrangement structure based on the timing synchronization signal, and may supply the aligned digital video data to the data driver 200. The timing controller 300 may generate the data control signal and the gate control signal based on the timing synchronization signal. The timing controller 300 may control the supply timing of the data voltage of the data driver 200 based on the data control signal, and may control the supply timing of the gate signal of the gate driver based on the gate control signal.

The power supply unit 400 may be mounted on the control circuit board 600 and may supply a power voltage to the display panel 100 and the data driver 200. For example, the power supply unit 400 may generate a driving voltage or a high-potential voltage for driving the pixels and the data driver 200 of the display panel 100.

The data circuit board 500 may be disposed on a pad portion disposed at the edge on a side of the display panel 100. The data circuit board 500 may be attached to the pad portion using a conductive adhesive member such as an anisotropic conductive film. The data circuit board 500 may be electrically connected to signal lines of the display panel 100 through an anisotropic conductive film. The display panel 100 may receive a data voltage and a driving voltage from the data circuit board 500. For example, the data circuit board 500 may be a flexible printed circuit board, a printed circuit board, or a flexible film such as a chip on film (COF).

The control circuit board 600 may be attached to the data circuit board 500 using a low-resistance and high-reliability material such as an anisotropic conductive film or a self-assembly anisotropic conductive paste (SAP), or the like. The control circuit board 600 may be electrically connected to the data circuit board 500. The control circuit board 600 may be a flexible printed circuit board or a printed circuit board.

Figure 2:
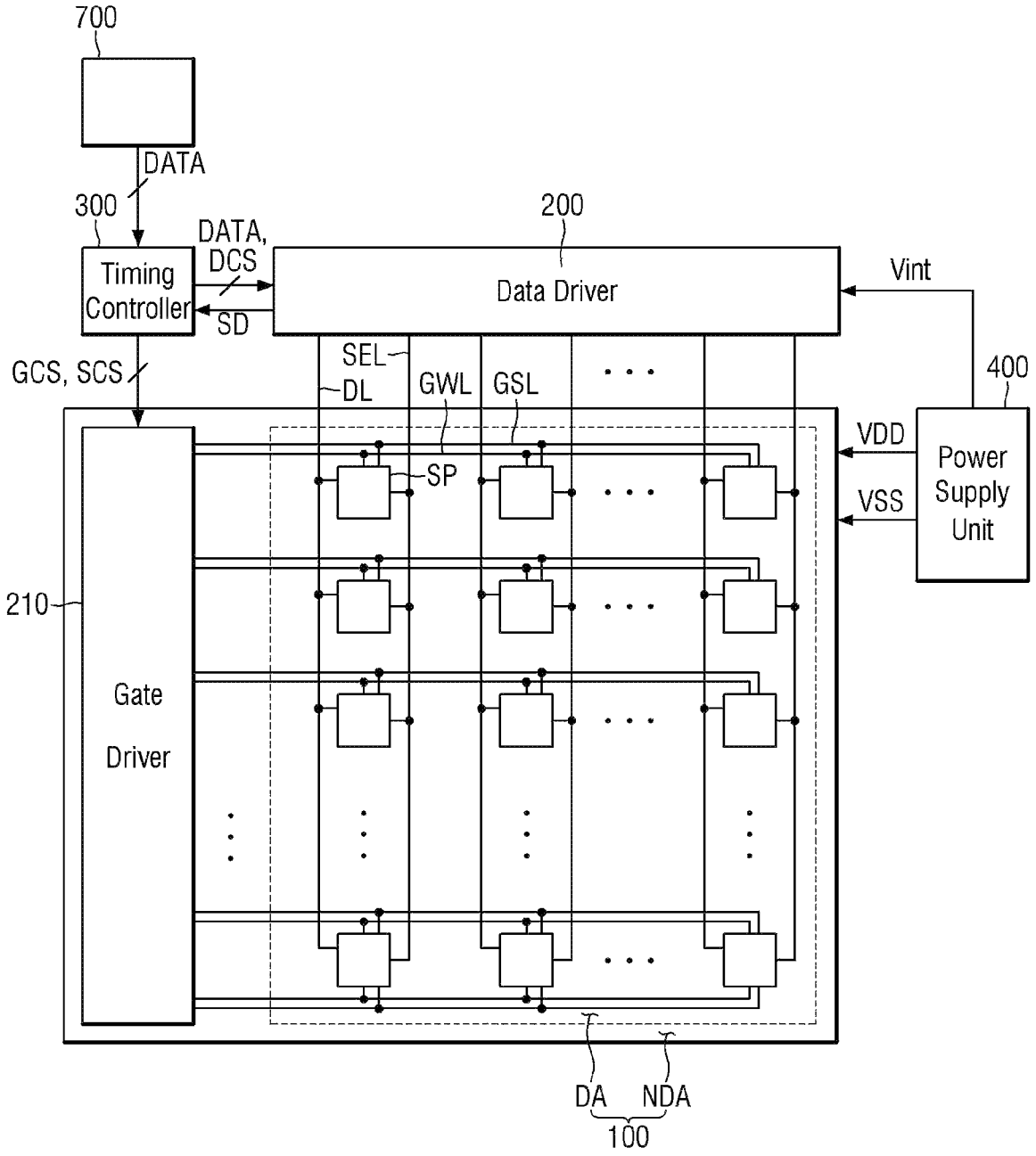
FIG. 2 is a schematic block diagram illustrating a display device according to an embodiment.

FIG. 2 is a schematic block diagram illustrating a display device according to an embodiment.

Referring to FIG. 2, the display device 10 may include the display panel 100, the data driver 200, a gate driver 210, the timing controller 300, the power supply unit 400, and a graphic device 700.

The display area DA of the display panel 100 may include pixels SP, and each of the pixels SP may be electrically connected to a first gate line GWL, a second gate line GSL, and a data line DL, and a sensing line SEL.

The first and second gate lines GWL and GSL may extend in the first direction (e.g., X-axis direction) and may be spaced apart from each other in the second direction (e.g., Y-axis direction). The first and second gate lines GWL and GSL may be electrically connected between the gate driver 210 and the pixel SP. Each of the first and second gate lines GWL and GSL may supply a gate signal to the pixel SP.

The data line DL and the sensing line SEL may extend in the second direction (e.g., Y-axis direction) and may be spaced apart from each other in the first direction (e.g., X-axis direction). The data line DL and the sensing line SEL may be electrically connected between the data driver 200 and the pixel SP. The data line DL may supply a data voltage to the pixel SP. The sensing line SEL may supply an initialization voltage to the pixel SP and may receive a sensing signal from the pixel SP.

The data driver 200 may receive digital video data DATA and a data control signal DCS from the timing controller 300. The data driver 200 may generate a data voltage based on the digital video data DATA and may supply the data voltage to the data line DL according to the data control signal DCS. For example, the data voltage may be supplied to a selected pixel SP among the pixels SP in synchronization with the first gate signal. The data voltage may determine the luminance of the pixel SP. The data driver 200 may supply sensing data SD received from the sensing line SEL to the timing controller 300.

The gate driver 210 may be disposed in the non-display area NDA of the display panel 100. For example, the gate driver 210 may be disposed on the edge of the display panel 100, but the disclosure is not limited thereto. As another example, the gate driver 210 may be disposed at both edges of the display panel 100. The gate driver 210 may receive a first gate control signal GCS and a second gate control signal SCS from the timing controller 300. The gate driver 210 may generate a first gate signal based on the first gate control signal GCS and supply the first gate signal to the first gate line GWL. The gate driver 210 may generate a second gate signal based on the second gate control signal SCS and supply the second gate signal to the second gate line GSL. The gate driver 210 may sequentially supply the first gate signal to the first gate lines GWL according to a preset order. The gate driver 210 may sequentially supply the second gate signal to the second gate lines GSL according to a preset order.

The timing controller 300 may receive digital video data DATA and a timing synchronization signal from the graphic device 700. For example, the graphic device 700 may be a graphic card of the display device 10, but the disclosure is not limited thereto. The timing controller 300 may generate a data control signal DCS and first and second gate control signals GCS and SCS based on the timing synchronization signal. The timing controller 300 may control the driving timing of the data driver 400 using the data control signal DCS and control the driving timing of the gate driver 200 using the first and second gate control signals GCS and SCS. The timing controller 300 may vary the driving frequency of the display panel 100 based on the input frequency of the digital video data DATA of the graphic device 700.

The timing controller 300 may receive the sensing data SD from the data driver 200. The sensing data SD may sense characteristics of a transistor such as electron mobility or a threshold voltage of a transistor of each of the pixels SP. The timing controller 300 may apply the sensing data SD to the digital video data DATA. The timing controller 300 may compensate for the characteristics of the transistor of each of the pixels SP by supplying the digital video data DATA the data driver 200. The digital video data DATA may reflect the sensing data SD. For example, the sensing data SD may be stored in a separate memory disposed on the control circuit board 600, but the disclosure is not limited thereto.

The power supply unit 400 may generate a driving voltage VDD, a low-potential voltage VSS, and an initialization voltage Vint. The power supply unit 400 may supply the driving voltage VDD to the pixels SP arranged on the display panel 100 through the driving voltage line. The power supply unit 400 may supply the low-potential voltage VSS to the pixels SP arranged on the display panel 100 through a low-potential line. For example, the driving voltage VDD may correspond to a high-potential voltage capable of driving the pixels SP, and the driving voltage VDD and the low-potential voltage VSS may be commonly supplied to the pixels SP. The power supply unit 400 may supply the initialization voltage Vint to the data driver 200. The initialization voltage Vint may be supplied to each of the pixels SP through the sensing line SEL, and may initialize a first electrode of the transistor of the pixel SP or a first electrode of the light emitting element.

Figure 3:
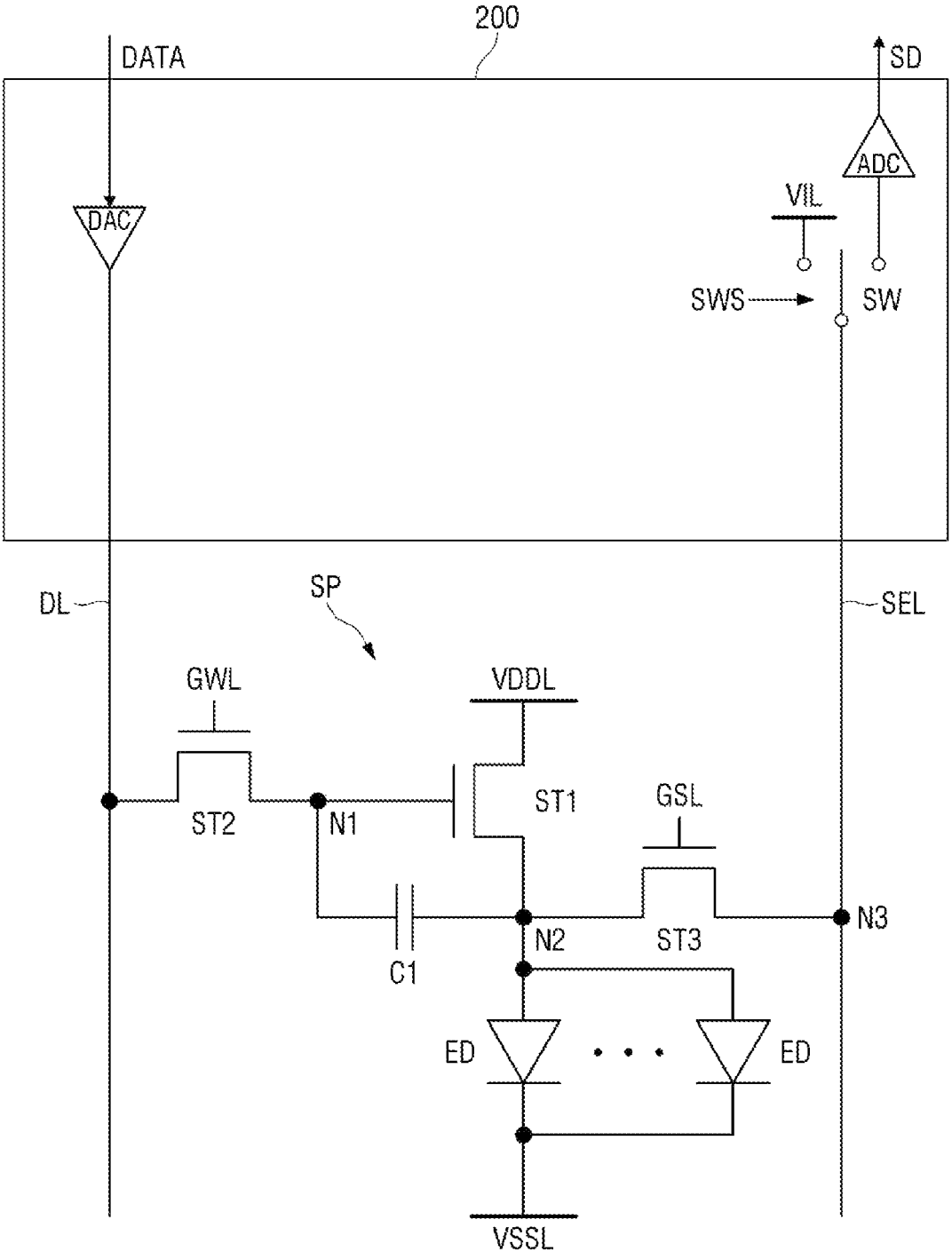
FIG. 3 is a schematic circuit diagram illustrating a data driver and a pixel of a display device according to an embodiment.

FIG. 3 is a schematic diagram of an equivalent circuit illustrating a data driver and a pixel of a display device according to an embodiment.

Referring to FIG. 3, each of the pixels SP may be electrically connected to the first gate line GWL, the second gate line GSL, the data line DL, the sensing line SEL, a driving voltage line VDDL, and a low-potential line VSSL.

The pixel SP may include first to third transistors ST1, ST2, and ST3, a first capacitor C1, and light emitting elements ED.

The first transistor ST1 may include a gate electrode, a drain electrode, and a source electrode. The gate electrode of the first transistor ST1 may be electrically connected to a first node N1, the drain electrode thereof may be electrically connected to the driving voltage line VDDL, and the source electrode thereof may be electrically connected to a second node N2. The first transistor T1 may be a driving transistor that adjusts a current flowing from the driving voltage line VDDL to the light emitting element ED according to a voltage difference between the gate electrode and the source electrode. The first transistor ST1 may control a drain-source current (or a driving current) based on a data voltage applied to the gate electrode.

The light emitting elements ED may emit light by receiving the driving current. The light emitting elements ED may be electrically connected to each other in parallel, but the disclosure is not limited thereto. The emission amount or the luminance of the light emitting element ED may be proportional to the magnitude of the driving current. The light emitting element ED may include at least one of an organic light emitting diode including an organic light emitting layer, a quantum dot light emitting diode including a quantum dot light emitting layer, an inorganic light emitting diode including an inorganic semiconductor, or a micro light emitting diode (micro LED), but the disclosure is not limited thereto.

A first electrode of the light emitting element ED may be electrically connected to the second node N2. The first electrode of the light emitting element ED may be electrically connected to the source electrode of the first transistor ST1, a drain electrode of the third transistor ST3, and a second capacitor electrode of the first capacitor C1, through the second node N2. A second electrode of the light emitting element ED may be electrically connected to a low-potential line VSSL.

The second transistor ST2 may be turned on by the first gate signal of the first gate line GWL to electrically connect the data line DL to the first node N1, which is the gate electrode of the first transistor ST1. The second transistor ST2 may be turned on according to the first gate signal to supply the data voltage to the first node N1. A gate electrode of the second transistor ST2 may be electrically connected to the first gate line GWL, a drain electrode thereof may be electrically connected to the data line DL, and a source electrode thereof may be electrically connected to the first node N1. The source electrode of the second transistor ST2 may be electrically connected to the gate electrode of the first transistor ST1 and a first capacitor electrode of the first capacitor C1 through the first node N1.

The third transistor ST3 may be turned on by the second gate signal of the second gate line GSL, and may electrically connect a third node N3, which is the sensing line SEL, to the second node N2, which is the source electrode of the first transistor ST1. The third transistor ST3 may be turned on according to the second gate signal to supply the initialization voltage to the second node N2. A gate electrode of the third transistor ST3 may be electrically connected to the second gate line GSL, the drain electrode thereof may be electrically connected to the second node N2, and a source electrode thereof may be electrically connected to the third node N3, which is the sensing line SEL. The drain electrode of the third transistor ST3 may be electrically connected to the source electrode of the first transistor ST1, the second capacitor electrode of the first capacitor C1, and the first electrode of the light emitting element ED, through the second node N2.

For example, the drain electrode and the source electrode of each of the first to third transistors ST1, ST2, and ST3 are not limited to the above description, and may be formed opposite to each other. Each of the first to third transistors ST1, ST2, and ST3 may be an N-type metal-oxide-semiconductor field-effect transistor (MOSFET), but the disclosure is not limited thereto.

The data driver 200 may include a switching element SW, an analog-to-digital converter ADC, and a digital-to-analog converter DAC.

The switching element SW may electrically connect the sensing line SEL to the initialization voltage line VIL or the analog-to-digital converter ADC based on a switching signal SWS. In case that the initialization voltage line VIL is electrically connected to the sensing line SEL, the initialization voltage line VIL may supply the initialization voltage Vint to the sensing line SEL. In case that the analog-to-digital converter ADC is electrically connected to the sensing line SEL, the sensing line SEL may supply a sensing signal to the analog-to-digital converter ADC, and the analog-to-digital converter ADC may convert the sensing signal to digital data to generate the sensing data SD. The analog-to-digital converter ADC may supply the sensing data SD to a compensation circuit (not illustrated) of the timing controller 300.

The digital-to-analog converter DAC may receive the digital video data DATA from the compensation circuit of the timing controller 300. The digital video data DATA may reflect the sensing data SD. The digital-to-analog converter DAC may convert the digital video data DATA into analog data to generate a data voltage Vdata. The digital-to-analog converter DAC may supply the data voltage Vdata to the data line DL.

Figure 4:
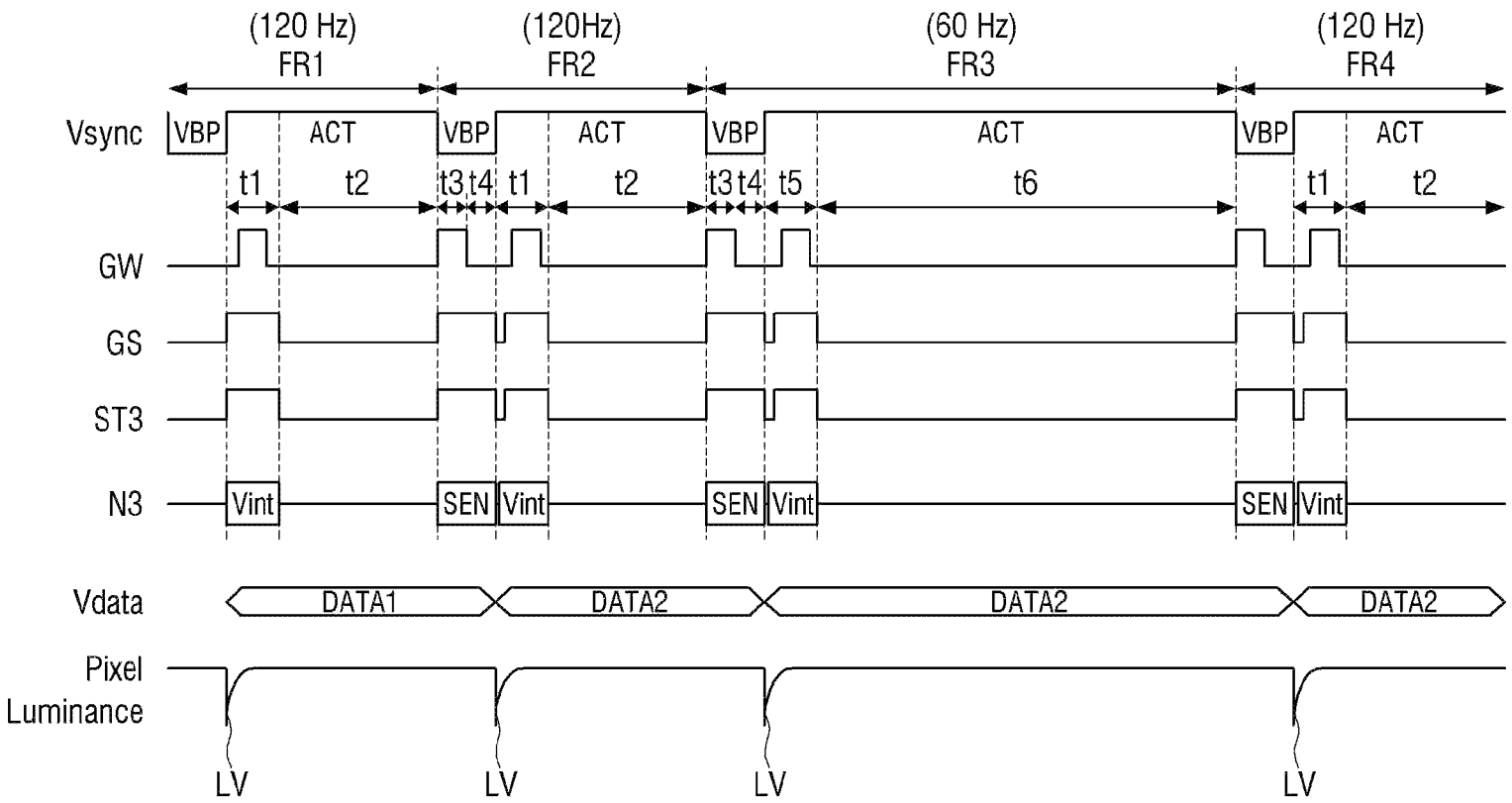
FIG. 4 is a schematic timing diagram illustrating signals and voltages of a display device according to an embodiment.

FIG. 4 is a schematic timing diagram illustrating signals and voltages of a display device according to an embodiment.

Referring to FIG. 4, the display device 10 may be driven at a first driving frequency and a second driving frequency smaller than the first driving frequency. The first driving frequency may be an integer multiple of the second driving frequency, but the disclosure is not limited thereto. For example, the first driving frequency may be about 120 Hz, and the second driving frequency may be about 60 Hz, but the disclosure is not limited thereto.

The display device may be driven at a driving frequency of about 120 Hz during first and second frame periods FR1 and FR2, may be changed to a driving frequency of about 60 Hz during a third frame period FR3, and may be changed back to a driving frequency of about 120 Hz during a fourth frame period FR4. For example, the length of the third frame period FR3 may be twice the length of each of the first, second, and fourth frame periods FR1, FR2, and FR4.

The timing controller 300 may control the data driver 200 and the gate driver 210 based on a vertical synchronization signal Vsync. The vertical synchronization signal Vsync may have a low level and a high level during a frame period. The vertical synchronization signal Vsync may have a low level during an idle period VBP and a high level during an active period ACT. The pixels SP may emit light during the active period ACT. The pixels SP disposed in some rows among the pixels SP may be sensed by the data driver 200 during a sensing period SEN, and other pixels SP disposed in other rows among the pixels SP may maintain the luminance acquired in a previous active period ACT during the idle period VBP. Accordingly, the sensing period SEN may be applied to the pixels SP in some rows during the idle period VBP.

The data driver 200 may receive first and second digital video data DATA1 and DATA2 from the graphic device 700. The data driver 200 may output the data voltage Vdata generated based on the first digital video data DATA1 during the first frame period FR1 of the first driving frequency. The data driver 200 may output the data voltage Vdata generated based on the second digital video data DATA2 during the second frame period FR2 of the first driving frequency, the third frame period FR3 of the second driving frequency, and the fourth frame period FR4 of the first driving frequency. Accordingly, the data voltage Vdata based on the digital video data DATA may be changed in or during the second frame period FR2, and during the third and fourth frame periods FR3 and FR4, the driving frequency may be changed while the data voltage Vdata is maintained.

A first period t1 of the first and second frame periods FR1 and FR2 and a fifth period t5 of the third frame period FR3 may be data addressing periods for supplying data voltages to the pixels SP. A second period t2 of the first and second frame periods FR1 and FR2 and a sixth period t6 of the third frame period FR3 may be blank periods in which data voltages are not supplied to the pixels SP.

The length of the third frame period FR3 may be twice the length of each of the first, second, and fourth frame periods FR1, FR2, and FR4. The sum of the lengths of the first and second frame periods FR1 and FR2 may be equal to the length of the third frame period FR3. The lengths of the idle periods VBP of the first and third frame periods FR1 and FR3 may be the same, and the first period t1 of the first frame period FR1 may be the same as the fifth period t5 of the third frame period FR3. A sixth period t6 of the third frame period FR3 may be more than twice the second period t2 of the first frame period FR1. As the second driving frequency decreases, the length of the sixth period t6 may increase. Accordingly, the display device 10 may match the driving frequency of the data driver 200 with the input frequency of the graphic device 700 by adjusting the blank periods of the frame periods, and may perform frequency variable driving to prevent image quality degradation.

The display device 10 may supply the data voltage Vdata to the second transistor ST2 of the pixels SP in the data addressing period, and may supply the initialization voltage Vint to the third transistor ST3 of the pixels SP. The display device 10 may supply the data voltage Vdata and the initialization voltage Vint to the pixels SP during the first period t1 of each of the first and second frame periods FR1 and FR2 and the fifth period t5 of the third frame period FR3. In case that the initialization voltage Vint is supplied to the pixels SP, the pixels SP may have a luminance valley LV. The luminance valley LV refers to luminance degradation or luminance reset that occurs in case that the first electrode of the light emitting element ED of the pixels SP receives the initialization voltage Vint and does not emit light. The first and second frame periods FR1 and FR2 may have two luminance valleys LV, and the third frame period FR3 may have a luminance valley LV. The display device 10 may have a luminance valley LV at about 60 Hz while having two luminance valleys LV at about 120 Hz. Accordingly, in the display device of FIGS. 3 and 4, a luminance difference of an image may occur in case that the driving frequency is changed.

Figure 5:
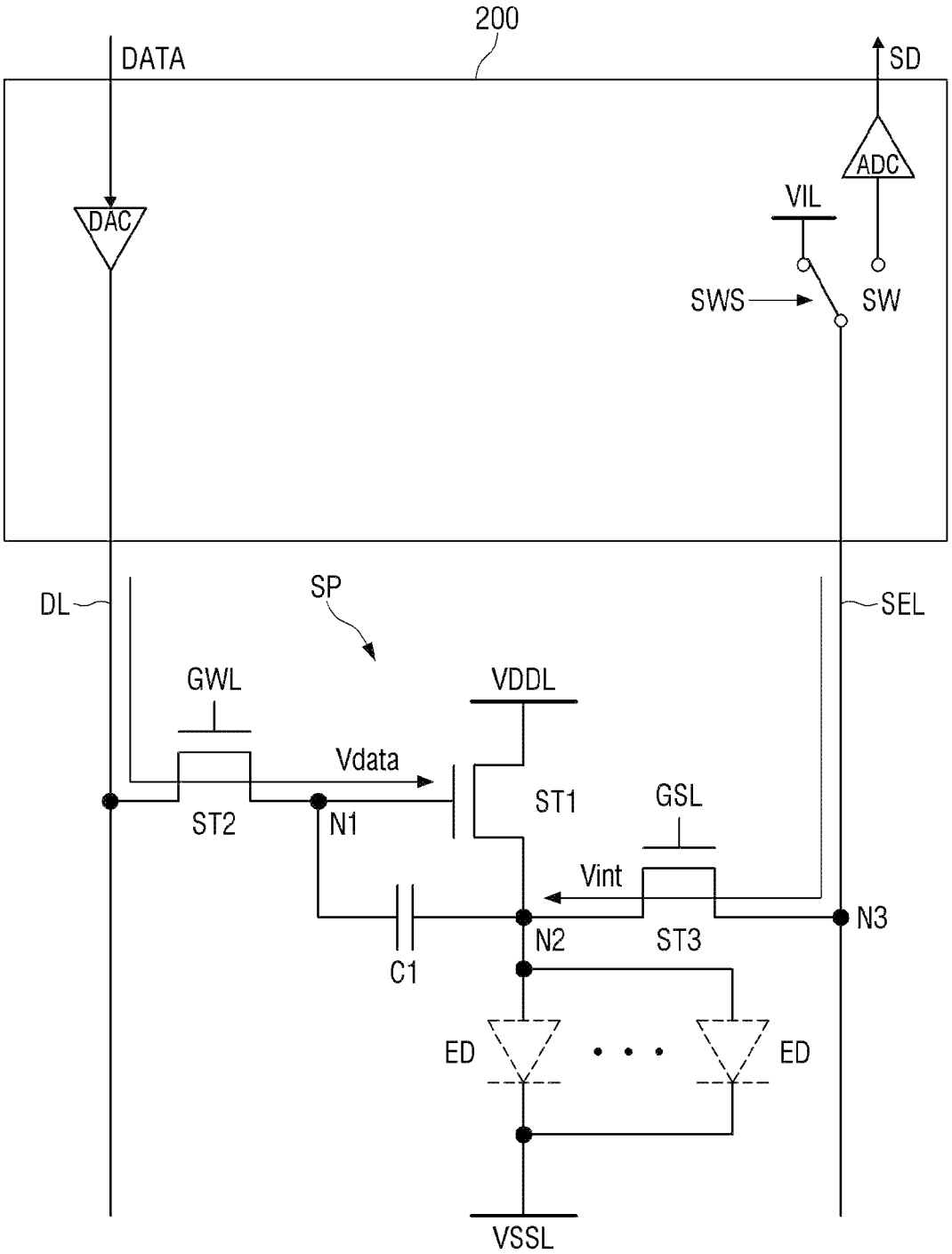
FIG. 5 is a schematic diagram of an equivalent circuit illustrating an operation of a pixel during a first period of FIG. 4 in a display device according to an embodiment.

FIG. 5 is a schematic diagram of an equivalent circuit illustrating an operation of a pixel during a first period of FIG. 4 in a display device according to an embodiment. The operation of the pixel SP of FIG. 5 may be different from the operation of the fifth period t5 of the third frame period FR3 at least in a difference in the data voltage Vdata.

Referring to FIG. 5 in conjunction with FIG. 4, the pixel SP may receive a first gate signal GW of a high level (or gate-on voltage) and a second gate signal GS of a high level during the first period t1 of the active period ACT. The data line DL may supply the data voltage Vdata generated based on the first digital video data DATA1 to the pixel SP during the first period t1 of the first frame period FR1. The second transistor ST2 may be turned on during the first period t1 to supply the data voltage Vdata to the first node N1, which is the gate electrode of the first transistor ST1. The switching element SW may electrically connect the initialization voltage line VIL to the third node N3, which is the sensing line SEL, during the first period t1. The initialization voltage line VIL may supply the initialization voltage Vint to the third node N3 during the first period t1. The third transistor ST3 may be turned on during the first period t1 to supply the initialization voltage Vint to the second node N2, which is the source electrode of the first transistor ST1.

Figure 6:
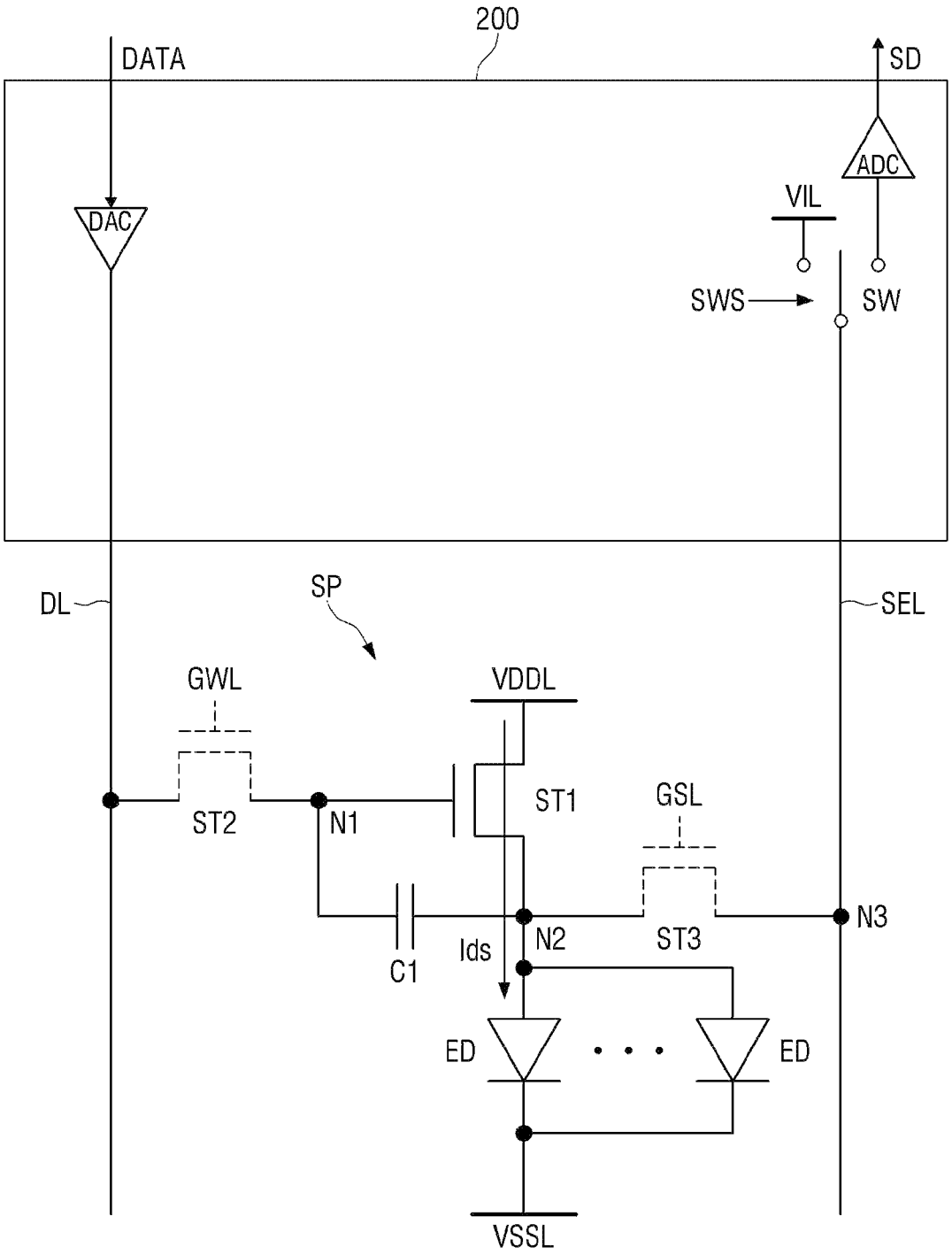
FIG. 6 is a schematic diagram of an equivalent circuit illustrating an operation of a pixel during a second period of FIG. 4 in a display device according to an embodiment.

FIG. 6 is a schematic diagram of an equivalent circuit illustrating an operation of a pixel during a second period of FIG. 4 in a display device according to an embodiment. The operation of the pixel SP of FIG. 6 may be different from the operation of the sixth period t6 of the third frame period FR3 at least in the difference of the data voltage Vdata and the length of the period.

Referring to FIG. 6 in conjunction with FIG. 4, the pixel SP may receive the first gate signal GW of a low level (or gate-off voltage) and the second gate signal GS of a low level during the second period t2 of the active period ACT. The second and third transistors ST2 and ST3 may be turned off during the second period t2.

The first transistor ST1 may be turned on by the voltage difference between the gate electrode and the source electrode or the voltage difference between the first node N1 and the second node N2 during the second period t2. A drain-source current Ids (or driving current) of the first transistor ST1 may be supplied to the light emitting elements ED based on the gate-source voltage of the first transistor ST1. Accordingly, the light emitting elements ED may emit light during the second period t2.

Figure 7:
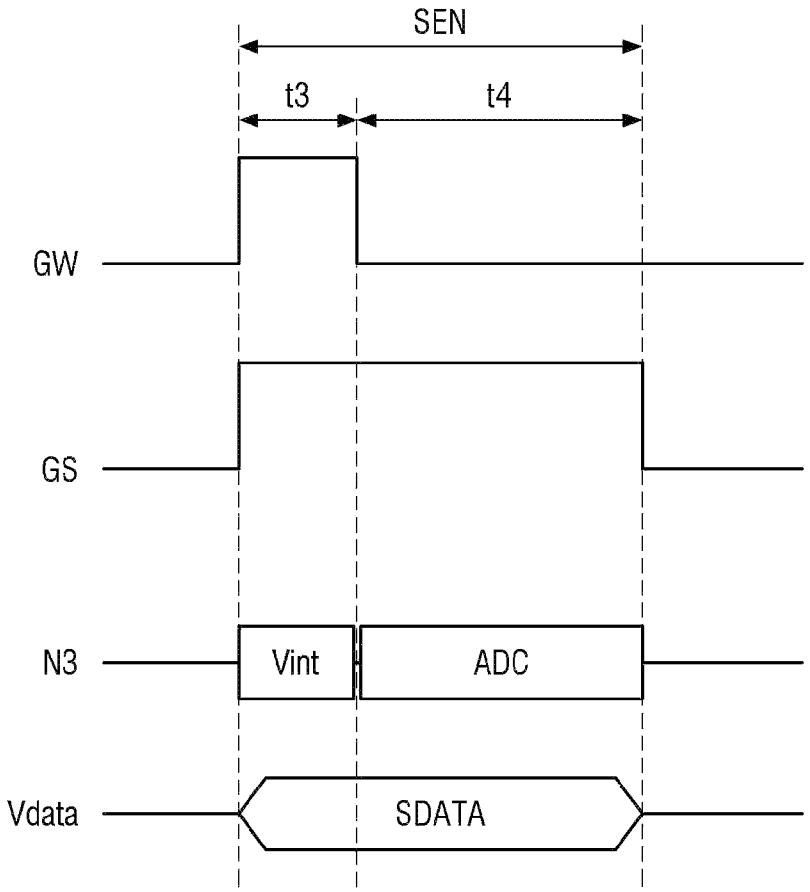
FIG. 7 is a schematic timing diagram illustrating signals and voltages in a sensing period in a display device according to an embodiment.
Figure 8:
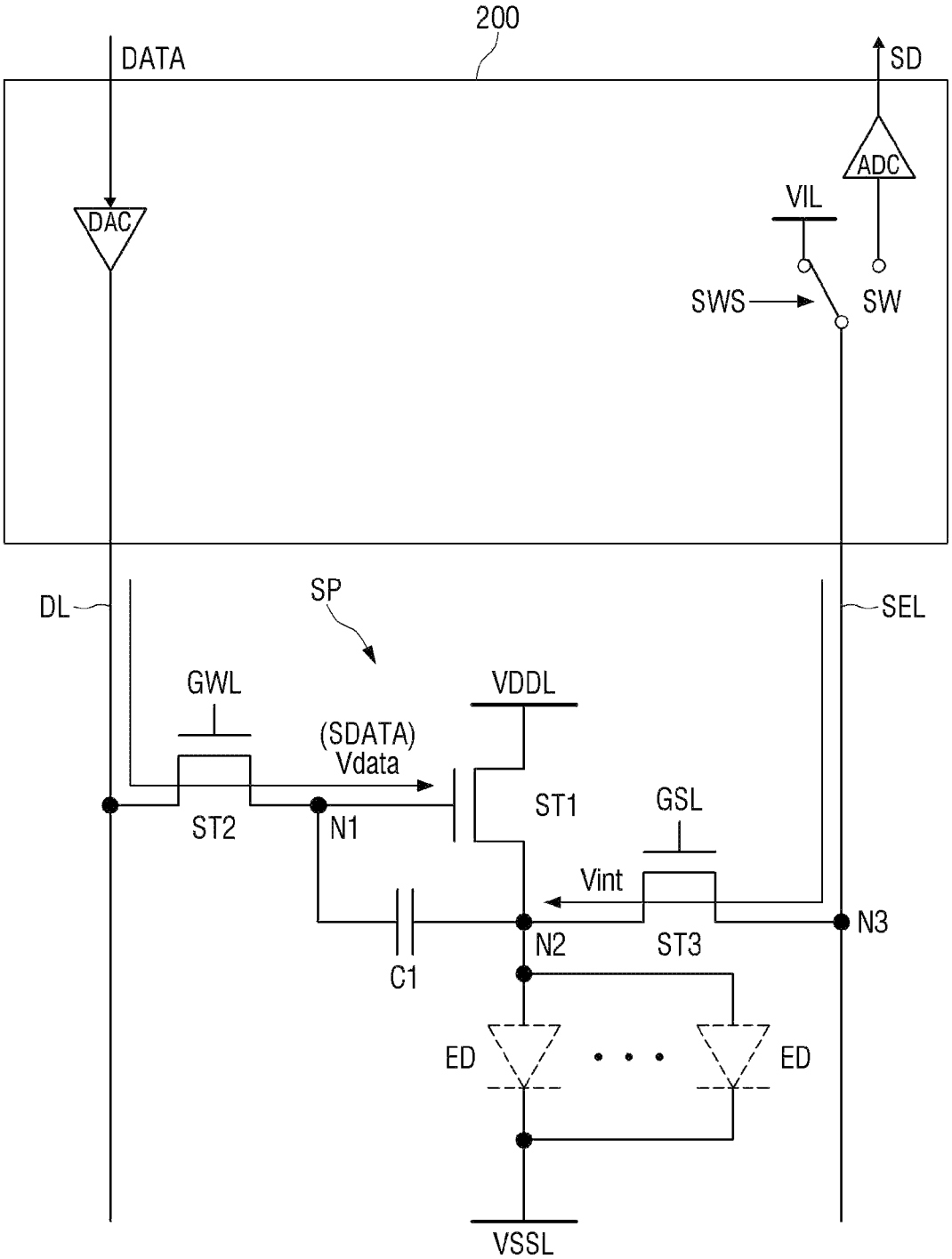
FIG. 8 is a schematic diagram of an equivalent circuit illustrating an operation of a pixel during a third period of FIG. 7 in the display device according to an embodiment.

FIG. 7 is a schematic timing diagram illustrating signals and voltages in a sensing period in a display device according to an embodiment, and FIG. 8 is a schematic diagram of an equivalent circuit illustrating an operation of a pixel during a third period of FIG. 7 in the display device according to an embodiment.

Referring to FIGS. 7 and 8, the pixels SP disposed in some rows among the pixels SP may be sensed by the data driver 200 during the sensing period SEN. The pixels SP disposed in some other rows among the pixels SP may maintain the luminance acquired in a previous active period ACT during the idle period VBP. Accordingly, the sensing period SEN may be applied to the pixels SP in some rows during the idle period VBP. The data driver 200 may sense characteristics such as electron mobility or a threshold voltage of the first transistor ST1 of the pixel SP during the sensing period SEN.

The pixel SP may receive the first gate signal GW of a high level (or a gate-on voltage) and the second gate signal GS of a high level during the third period t3 of the sensing period SEN. The data line DL may supply the data voltage Vdata corresponding to sensing data SDATA to the pixel SP during the third period t3. The second transistor ST2 may be turned on during the third period t3 to supply the data voltage Vdata to the first node N1, which is the gate electrode of the first transistor ST1. The switching element SW may electrically connect the initialization voltage line VIL to the third node N3, which is the sensing line SEL during the third period t3. The initialization voltage line VIL may supply the initialization voltage Vint to the third node N3 during the third period t3. The third transistor ST3 may be turned on during the third period t3 to supply the initialization voltage Vint to the second node N2, which is the source electrode of the first transistor ST1.

Figure 9:
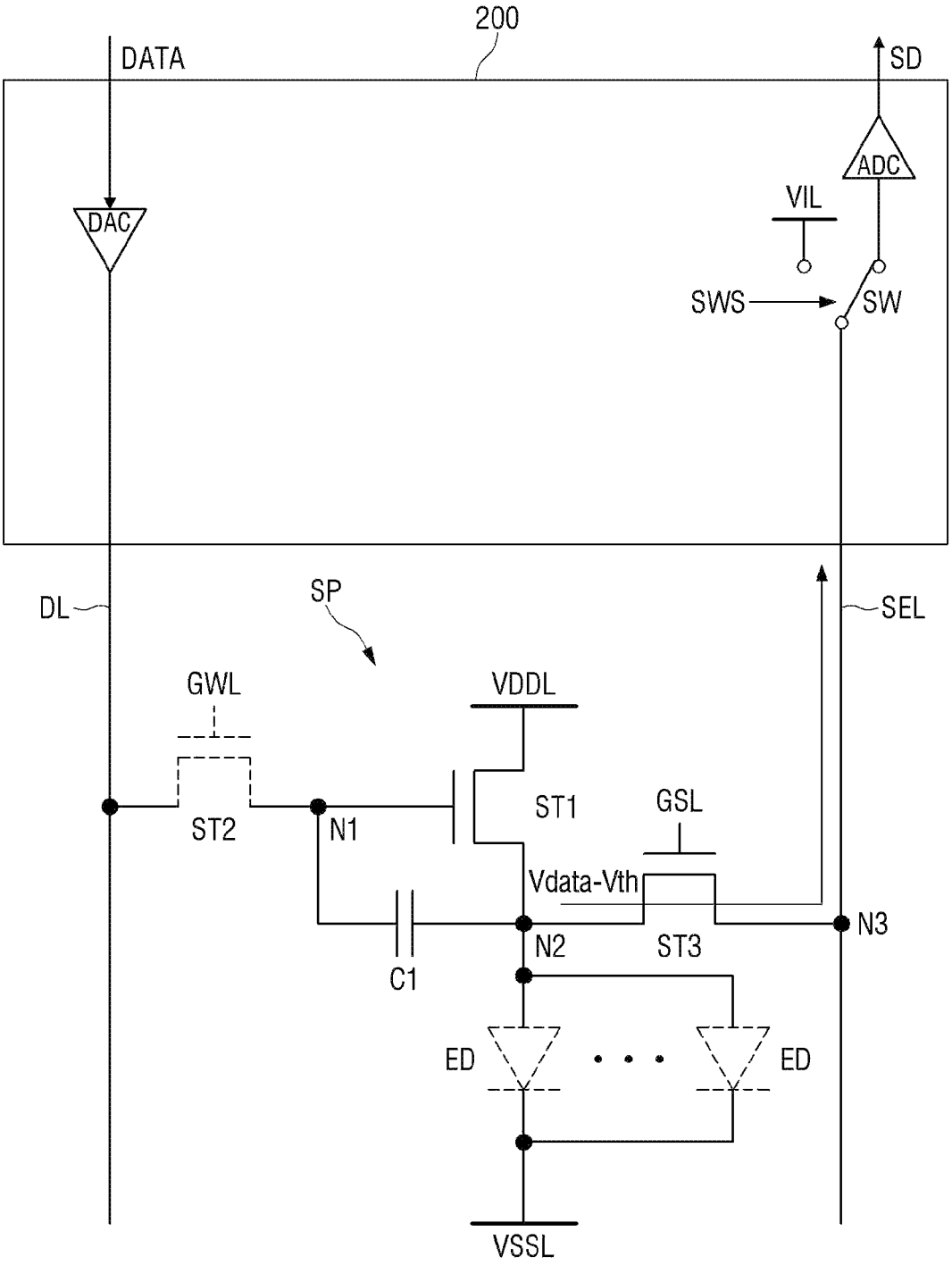
FIG. 9 is a schematic diagram of an equivalent circuit illustrating an operation of a pixel during a fourth period of FIG. 7 in a display device according to an embodiment.

FIG. 9 is a schematic diagram of an equivalent circuit illustrating an operation of a pixel during a fourth period of FIG. 7 in a display device according to an embodiment.

Referring to FIG. 9 in conjunction with FIG. 7, the pixel SP may receive the first gate signal GW of a low level (or gate-off voltage) and the second gate signal GS of a high level (or gate-on voltage) during the fourth period t4 of the sensing period SEN. The second transistor ST2 may be turned off during the fourth period t4. The switching element SW may electrically connect the analog-to-digital converter ADC to the third node N3, which is the sensing line SEL, during the fourth period t4. A gate-source voltage Vgs (Vgs=Vdata−Vint) of the first transistor ST1 may be greater than a threshold voltage Vth of the first transistor ST1 during the fourth period t4 (Vgs>Vth), and the first transistor ST1 may be turned on until the gate-source voltage Vgs of the first transistor ST1 reaches the threshold voltage Vth of the first transistor ST1. Accordingly, the voltage of the second node N2, which is the source electrode of the first transistor ST1, may rise to "Vdata−Vth," and the threshold voltage Vth of the first transistor ST1 may be sampled at the second node N2. The third transistor ST3 may be turned on during the fourth period t4, and the voltage of the second node N2 may be sensed as a sensing signal through the sensing line SEL.

Figure 10:
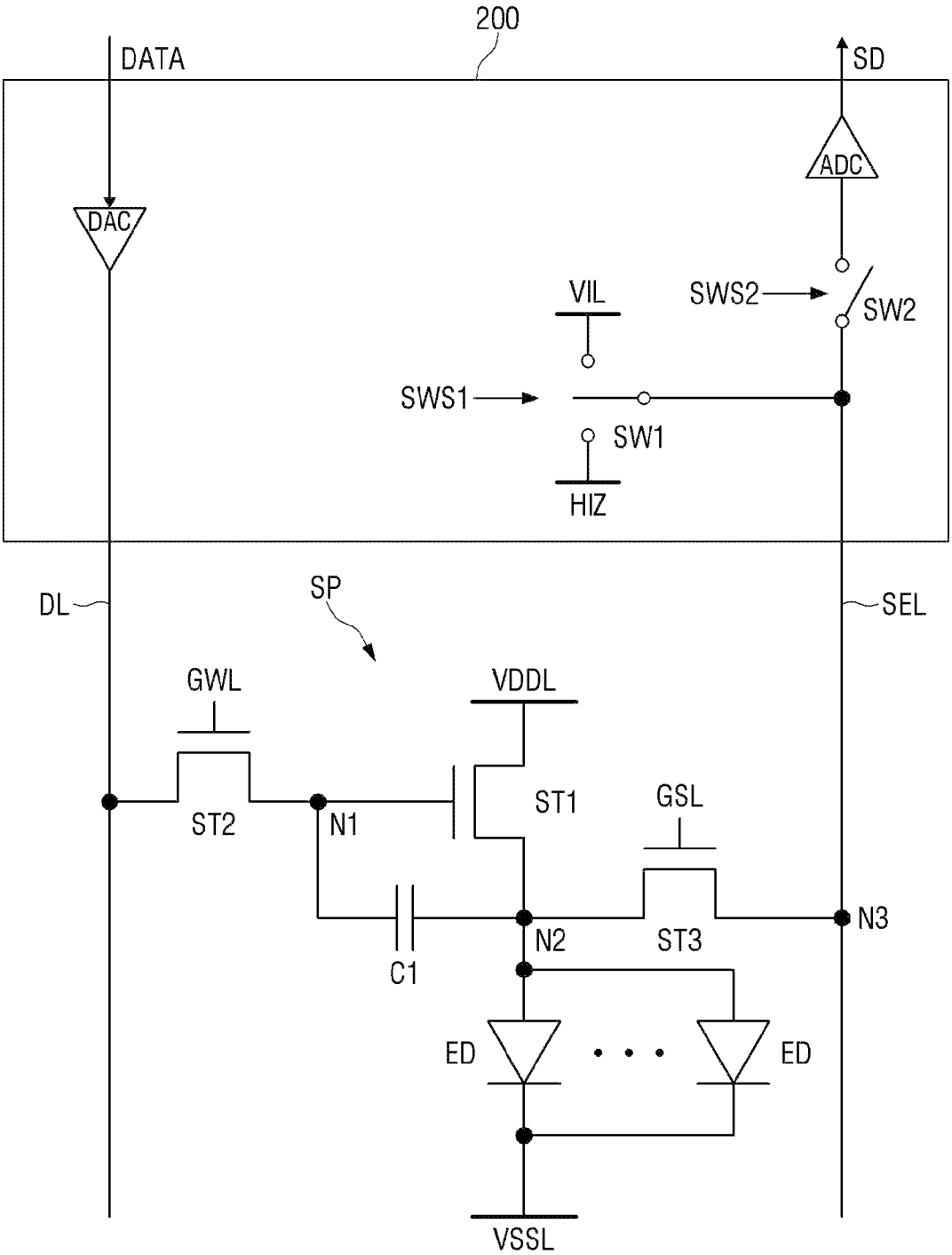
FIG. 10 is a schematic diagram of an equivalent circuit illustrating a data driver and a pixel of a display device according to another embodiment.

FIG. 10 is a schematic diagram of an equivalent circuit illustrating a data driver and a pixel of a display device according to another embodiment. The display device of FIG. 10 is different from the display device of FIG. 3 at least in the configuration of the data driver 200. Repetitive descriptions may be simplified or omitted.

Referring to FIG. 10, each of the pixels SP may be electrically connected to the first gate line GWL, the second gate line GSL, the data line DL, the sensing line SEL, a driving voltage line VDDL, and a low-potential line VSSL.

The pixel SP may include first to third transistors ST1, ST2, and ST3, a first capacitor C1, and light emitting elements ED.

The gate electrode of the first transistor ST1 may be electrically connected to the first node N1, the drain electrode thereof may be electrically connected to the driving voltage line VDDL, and the source electrode thereof may be electrically connected to a second node N2. The first transistor ST1 may control a drain-source current (or driving current) based on a data voltage applied to the gate electrode.

The light emitting elements ED may emit light by receiving the driving current. The light emitting elements ED may be electrically connected in parallel, but the disclosure is not limited thereto. The first electrode of the light emitting element ED may be electrically connected to the second node N2, and the second electrode of the light emitting element ED may be electrically connected to the low-potential line VSSL.

The second transistor ST2 may be turned on according to the first gate signal of the first gate line GWL to supply the data voltage to the first node N1. The gate electrode of the second transistor ST2 may be electrically connected to the first gate line GWL, the drain electrode thereof may be electrically connected to the data line DL, and the source electrode thereof may be electrically connected to the first node N1.

The third transistor ST3 may be turned on based on the second gate signal of the second gate line GSL to supply the initialization voltage to the second node N2. The gate electrode of the third transistor ST3 may be electrically connected to the second gate line GSL, the drain electrode thereof may be electrically connected to the second node N2, and the source electrode thereof may be electrically connected to the third node N3, which is the sensing line SEL.

The first capacitor C1 may be electrically connected between the first node N1 and the second node N2. The first capacitor C1 may maintain a potential difference between the first node N1 and the second node N2.

The data driver 200 may include a first switching element SW1, a second switching element SW2, the analog-to-digital converter ADC, and the digital-to-analog converter DAC.

The first switching element SW1 may electrically connect the sensing line SEL to the initialization voltage line VIL or a high impedance HIZ based on a first switching signal SWS1. In case that the initialization voltage line VIL is electrically connected to the sensing line SEL, the initialization voltage line VIL may supply the initialization voltage Vint to the sensing line SEL. In case that the sensing line SEL is electrically connected to the high impedance HIZ and floats, it is possible to prevent the voltage of the second node N2 from falling although a second gate signal of a high level is applied to the third transistor ST3.

The timing controller 300 may control the connection state of the first switching element SW1 by supplying the first switching signal SW of 2 bits to the first switching element SW1. For example, the first switching element SW1 may be controlled by the first switching signal SWS1 illustrated in Table 1 below.

| SWS1[1] | SWS1[0] | , SW1 |
|---|---|---|
| L | L | OFF |
| L | H | VIL |
| H | L | HIZ |
| H | H | N/A |

Table 1 Here, "SWS1[1]" may be a first bit of the first switching signal SWS1, and "SWS1[0]" may be a second bit of the first switching signal SWS1. "L" may be a low level, a gate-off voltage, or 0, and "H" may be a high level, a gate-on voltage, or 1. Accordingly, in case that the first switching signal SWS1 has a bit value of [LL], the first switching element SW1 may be turned off and may not be electrically connected to the initialization voltage line VIL and the high impedance HIZ. In case that the first switching signal SWS1 has a bit value of [LH], the first switching element SW1 may electrically connect the initialization voltage line VIL to the sensing line SEL. In case that the first switching signal SWS1 has a bit value of [HL], the first switching element SW1 may electrically connect the high impedance HIZ to the sensing line SEL. The first switching element SWS1 may not have a bit value of [HH].

The second switching element SW2 may electrically connect the sensing line SEL to the analog-to-digital converter ADC based on a second switching signal SWS2. In case that the analog-to-digital converter ADC is electrically connected to the sensing line SEL, the sensing line SEL may supply a sensing signal to the analog-to-digital converter ADC, and the analog-to-digital converter ADC may convert the sensing signal to digital data to generate the sensing data SD. The analog-to-digital converter ADC may supply the sensing data SD to a compensation circuit (not illustrated) of the timing controller 300.

The digital-to-analog converter DAC may receive the digital video data DATA from the compensation circuit of the timing controller 300. The digital video data DATA may reflect the sensing data SD. The digital-to-analog converter DAC may convert the digital video data DATA into analog data to generate a data voltage Vdata. The digital-to-analog converter DAC may supply the data voltage Vdata to the data line DL.

Figure 11:
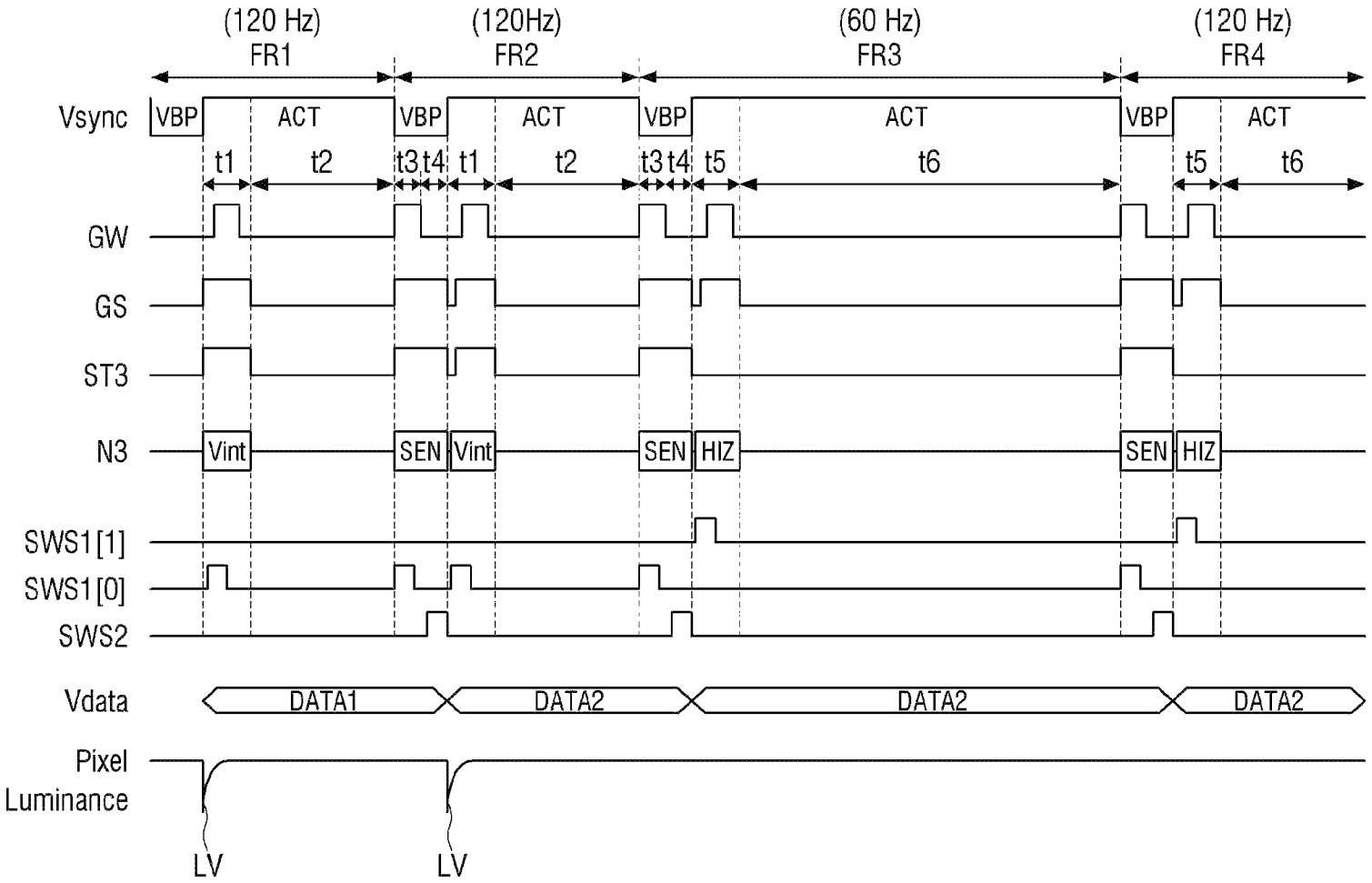
FIG. 11 is a schematic timing diagram illustrating signals and voltages of a display device according to another embodiment.

FIG. 11 is a schematic timing diagram illustrating signals and voltages of a display device according to another embodiment. The timing diagram of FIG. 11 is different from the timing diagram of FIG. 4 at least in the state of the third node N3, the state of the third transistor ST3, and the configuration of the first and second switching signals SWS1 and SWS2, and repetitive descriptions may be simplified or omitted.

Referring to FIG. 11, the display device 10 may be driven at a first driving frequency and a second driving frequency smaller than the first driving frequency. The first driving frequency may be an integer multiple of the second driving frequency, but the disclosure is not limited thereto. For example, the first driving frequency may be about 120 Hz, and the second driving frequency may be about 60 Hz, but the disclosure is not limited thereto.

The display device may be driven at a driving frequency of about 120 Hz during first and second frame periods FR1 and FR2, may be changed to a driving frequency of about 60 Hz during a third frame period FR3, and may be changed back to a driving frequency of about 120 Hz during a fourth frame period FR4. For example, the length of the third frame period FR3 may be twice the length of each of the first, second, and fourth frame periods FR1, FR2, and FR4.

The data driver 200 may receive first and second digital video data DATA1 and DATA2 from the graphic device 700. The data driver 200 may output the data voltage Vdata generated based on the first digital video data DATA1 during the first frame period FR1 of the first driving frequency. The data driver 200 may output the data voltage Vdata generated based on the second digital video data DATA2 during the second frame period FR2 of the first driving frequency, the third frame period FR3 of the second driving frequency, and the fourth frame period FR4 of the first driving frequency. Accordingly, the data voltage Vdata may be changed during the second frame period FR2, and the driving frequency may be changed during the third and fourth frame periods FR3 and FR4 while maintaining the data voltage Vdata.

A first period t1 of the first and second frame periods FR1 and FR2 and a fifth period t5 of the third frame period FR3 may be data addressing periods for supplying data voltages to the pixels SP. A second period t2 of the first and second frame periods FR1 and FR2 and a sixth period t6 of the third frame period FR3 may be blank periods in which no data voltages are supplied to the pixels SP.

The length of the third frame period FR3 may be twice the length of each of the first, second, and fourth frame periods FR1, FR2, and FR4. The sum of the lengths of the first and second frame periods FR1 and FR2 may be equal to the length of the third frame period FR3. The lengths of the idle periods VBP of the first and third frame periods FR1 and FR3 may be the same, and the first period t1 of the first frame period FR1 may be equal to the fifth period t5 of the third frame period FR3. A sixth period t6 of the third frame period FR3 may be more than twice the second period t2 of the first frame period FR1. As the second driving frequency decreases, the length of the sixth period t6 may increase. Accordingly, the display device 10 may match the driving frequency of the data driver 200 with the input frequency of the graphic device 700 by adjusting the blank periods of the frame periods, and may perform frequency variable driving to prevent reduction in image quality.

In case that the digital video data DATA is changed, the display device 10 may supply the data voltage Vdata to the second transistor ST2 of the pixels SP in the data addressing period, and may supply the initialization voltage Vint to the third transistor ST3 of the pixels SP. The display device 10 may supply the data voltage Vdata and the initialization voltage Vint to the pixels SP during the first period t1 of each of the first and second frame periods FR1 and FR2. In case that the initialization voltage Vint is supplied to the pixels SP, the pixels SP may have a luminance valley LV.

In case that the digital video data DATA is not changed, the display device 10 may supply the data voltage Vdata to the second transistors ST2 of the pixels SP in the data addressing period, and may electrically connect the third node N3, which is the sensing line SEL, to the high impedance HIZ. The display device 10 may electrically connect the third node N3, which is the sensing line SEL, to the high impedance HIZ during the fifth period t5 of the third frame period FR3 and the fifth period t5 of the fourth frame period FR4. In this case, the gate electrode of the third transistor ST3 may receive the second gate signal GS of a high level, but the source electrode of the third transistor ST3 may be electrically connected to the high impedance HIZ, so that the gate-source voltage Vgs of the third transistor ST3 may be smaller than the threshold voltage Vth of the third transistor ST3 (Vgs<Vth). The third transistor ST3 may be turned off during the fifth period t5 or the data addressing period of each of the third and fourth frame periods FR3 and FR4, and the voltage of the second node N2 may be stably maintained. In case that the digital video data DATA is not changed, the first electrode of the light emitting element ED may not receive the initialization voltage Vint during the data addressing period, so that the display device 10 may not have the luminance valley LV, and the luminance may not be reset. Accordingly, since the display device 10 does not have the luminance valley LV in case that the frequency variable driving is performed without changing the digital video data DATA, luminance degradation during the data addressing period may be minimized, and luminance differences between driving frequencies may be improved. As a result, the display device 10 may improve image quality in variable refresh rate (VRR) driving.

Figure 12:
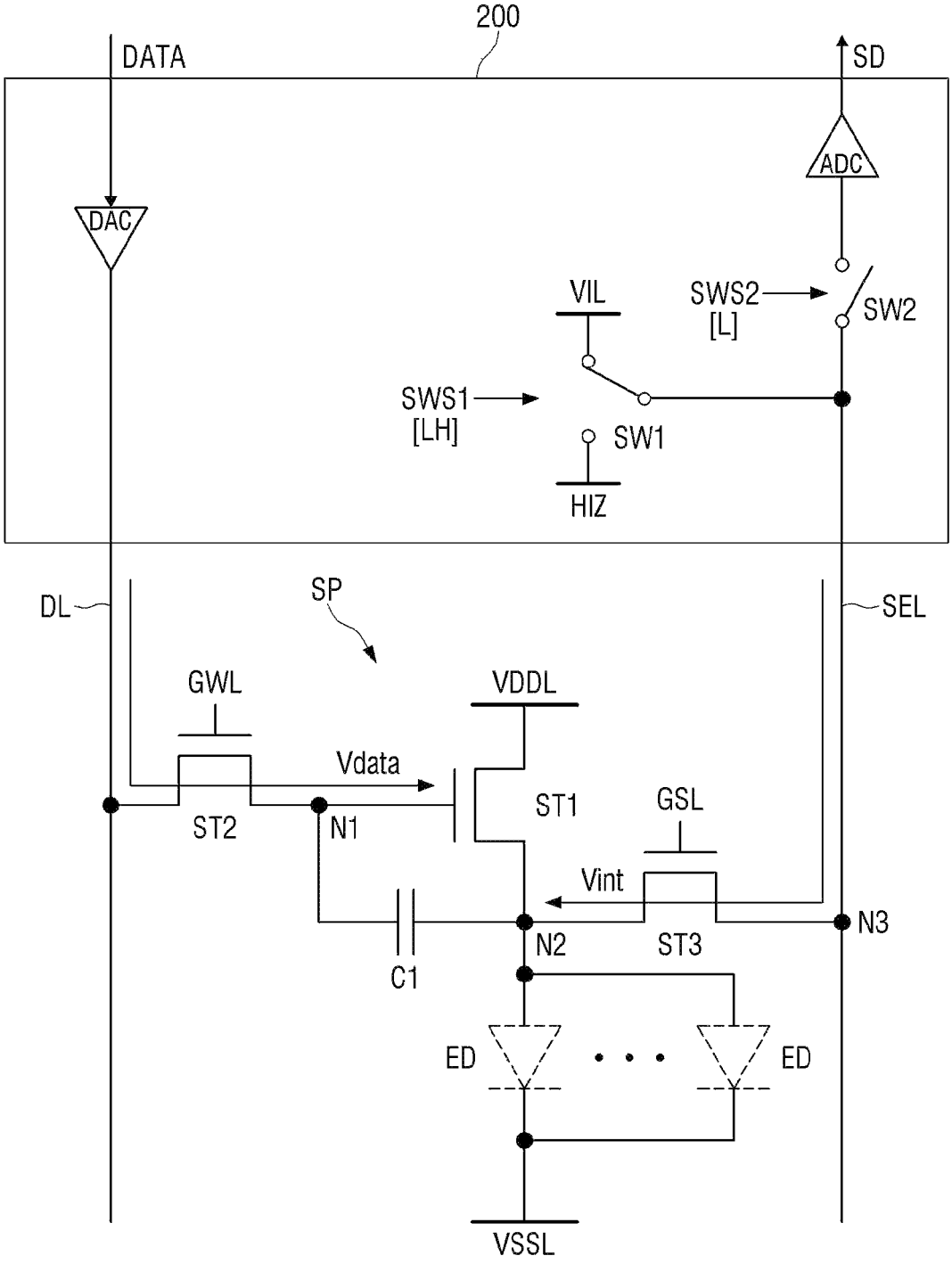
FIG. 12 is a schematic diagram of an equivalent circuit illustrating an operation of a pixel during a first period of FIG. 11 in a display device according to another embodiment.

FIG. 12 is a schematic diagram of an equivalent circuit illustrating an operation of a pixel during a first period of FIG. 11 in a display device according to another embodiment.

Referring to FIG. 12 in conjunction with FIG. 11, the pixel SP may receive the first gate signal GW of a high level (or gate-on voltage) and the second gate signal GS of a high level during the first period t1 of the active period ACT. The data line DL may supply the data voltage Vdata generated based on the first digital video data DATA1 to the pixel SP during the first period t1 of the first frame period FR1. The second transistor ST2 may be turned on during the first period t1 to supply the data voltage Vdata to the first node N1, which is the gate electrode of the first transistor ST1. The first switching element SW1 may receive the first switching signal SWS1 having a bit value of [LH] during the first period t1, and may electrically connect the initialization voltage line VIL to the third node N3, which is the sensing line SEL. The initialization voltage line VIL may supply the initialization voltage Vint to the third node N3 during the first period t1. The third transistor ST3 may be turned on during the first period t1 to supply the initialization voltage Vint to the second node N2, which is the source electrode of the first transistor ST1.

Figure 13:
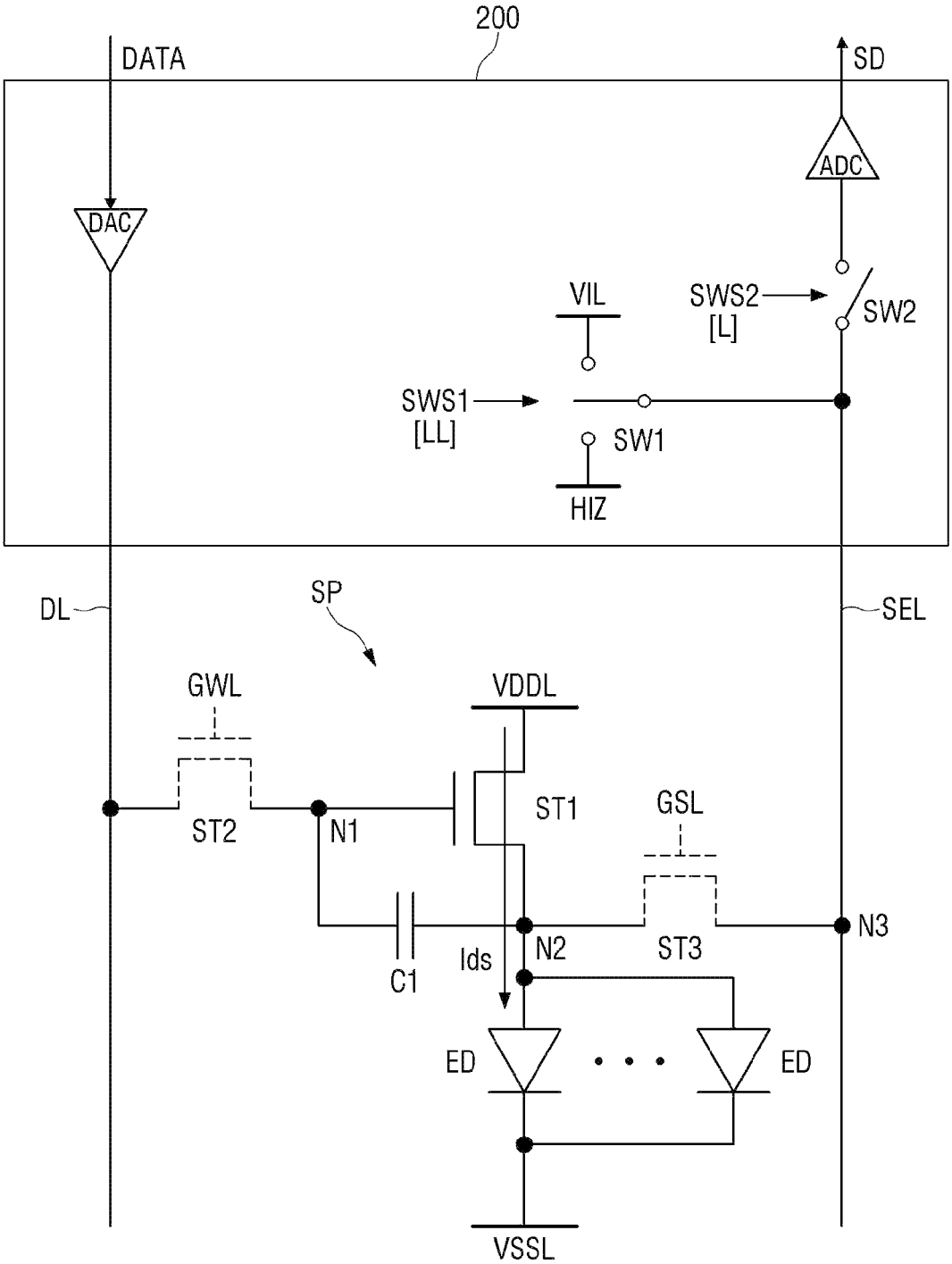
FIG. 13 is a schematic diagram of an equivalent circuit illustrating an operation of a pixel during a second period of FIG. 11 in a display device according to another embodiment.

FIG. 13 is a schematic diagram of an equivalent circuit illustrating an operation of a pixel during a second period of FIG. 11 in a display device according to another embodiment.

Referring to FIG. 13 in conjunction with FIG. 11, the pixel SP may receive the first gate signal GW of a low level (or gate-off voltage) and the second gate signal GS of a low level during the second period t2 of the active period ACT. The second and third transistors ST2 and ST3 may be turned off during the second period t2.

The first transistor ST1 may be turned on by the voltage difference between the gate electrode and the source electrode or the voltage difference between the first node N1 and the second node N2 during the second period t2. The first switching element SW1 may receive the first switching signal SWS1 having a bit value of [LL] during the second period t2 and may be turned off. A drain-source current Ids (or driving current) of the first transistor ST1 may be supplied to the light emitting elements ED based on the gate-source voltage of the first transistor ST1. Accordingly, the light emitting elements ED may emit light during the second period t2.

Figure 14:
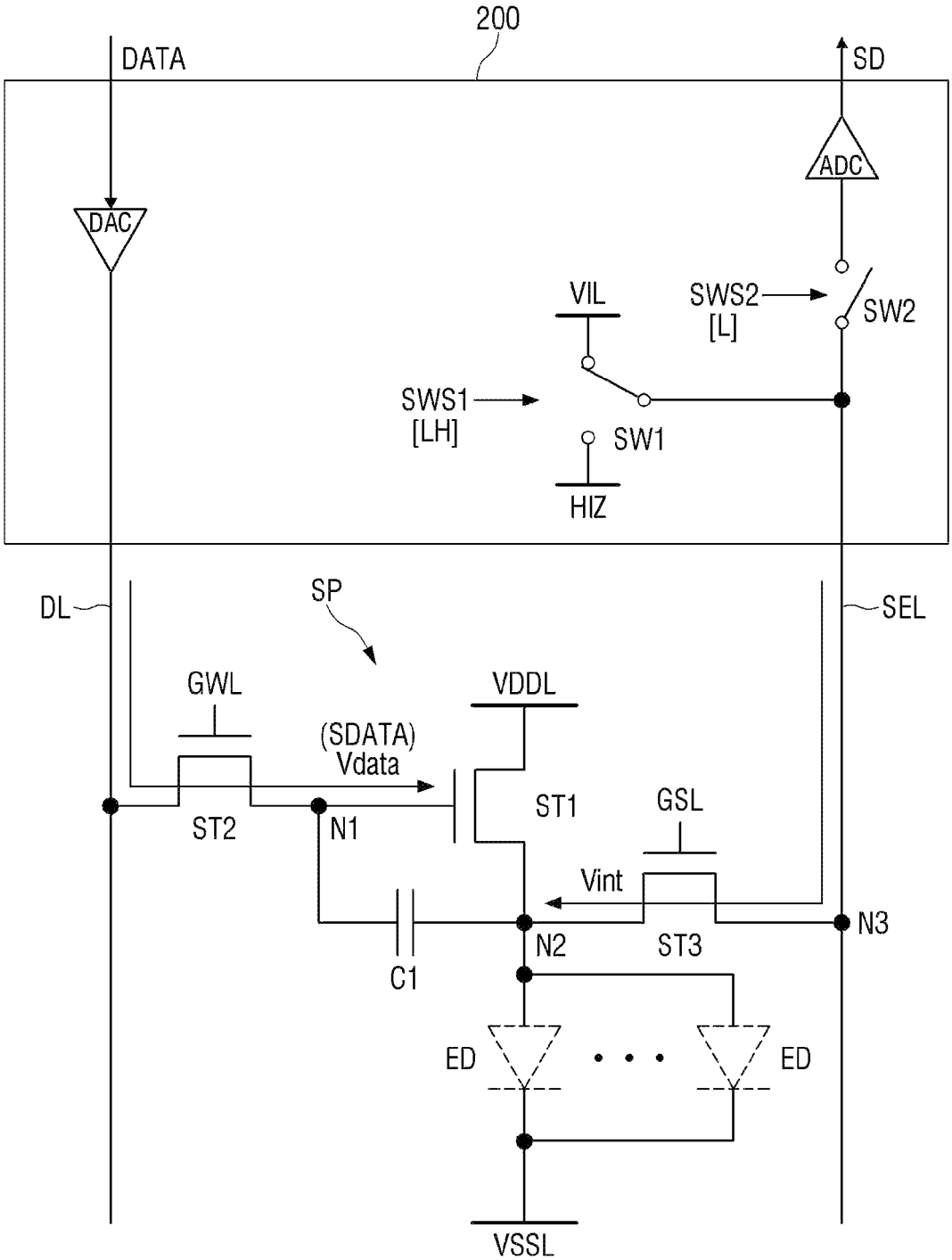
FIG. 14 is a schematic diagram of an equivalent circuit illustrating an operation of a pixel during a third period of FIG. 11 in a display device according to another embodiment.

FIG. 14 is a schematic diagram of an equivalent circuit illustrating an operation of a pixel during a third period of FIG. 11 in a display device according to another embodiment.

Referring to FIG. 14 in conjunction with FIG. 11, the pixels SP disposed in some rows among the pixels SP may be sensed by the data driver 200 during the sensing period SEN. The pixels SP disposed in some other rows among the pixels SP may maintain the luminance acquired in the previous active period ACT during the idle period VBP. Accordingly, the sensing period SEN may be applied to the pixels SP in some rows during the idle period VBP. The data driver 200 may sense characteristics such as electron mobility or a threshold voltage of the first transistor ST1 of the pixel SP during the sensing period SEN.

The pixel SP may receive the first gate signal GW of a high level (or gate-on voltage) and the second gate signal GS of a high level during the third period t3 of the sensing period SEN. The data line DL may supply the data voltage Vdata corresponding to sensing data SDATA to the pixel SP during the third period t3. The second transistor ST2 may be turned on during the third period t3 to supply the data voltage Vdata to the first node N1, which is the gate electrode of the first transistor ST1. The first switching element SW1 may receive the first switching signal SWS1 having a bit value of [LH] during the third period t3, and may electrically connect the initialization voltage line VIL to the third node N3, which is the sensing line SEL. The initialization voltage line VIL may supply the initialization voltage Vint to the third node N3 during the third period t3. The third transistor ST3 may be turned on during the third period t3 to supply the initialization voltage Vint to the second node N2, which is the source electrode of the first transistor ST1.

Figure 15:
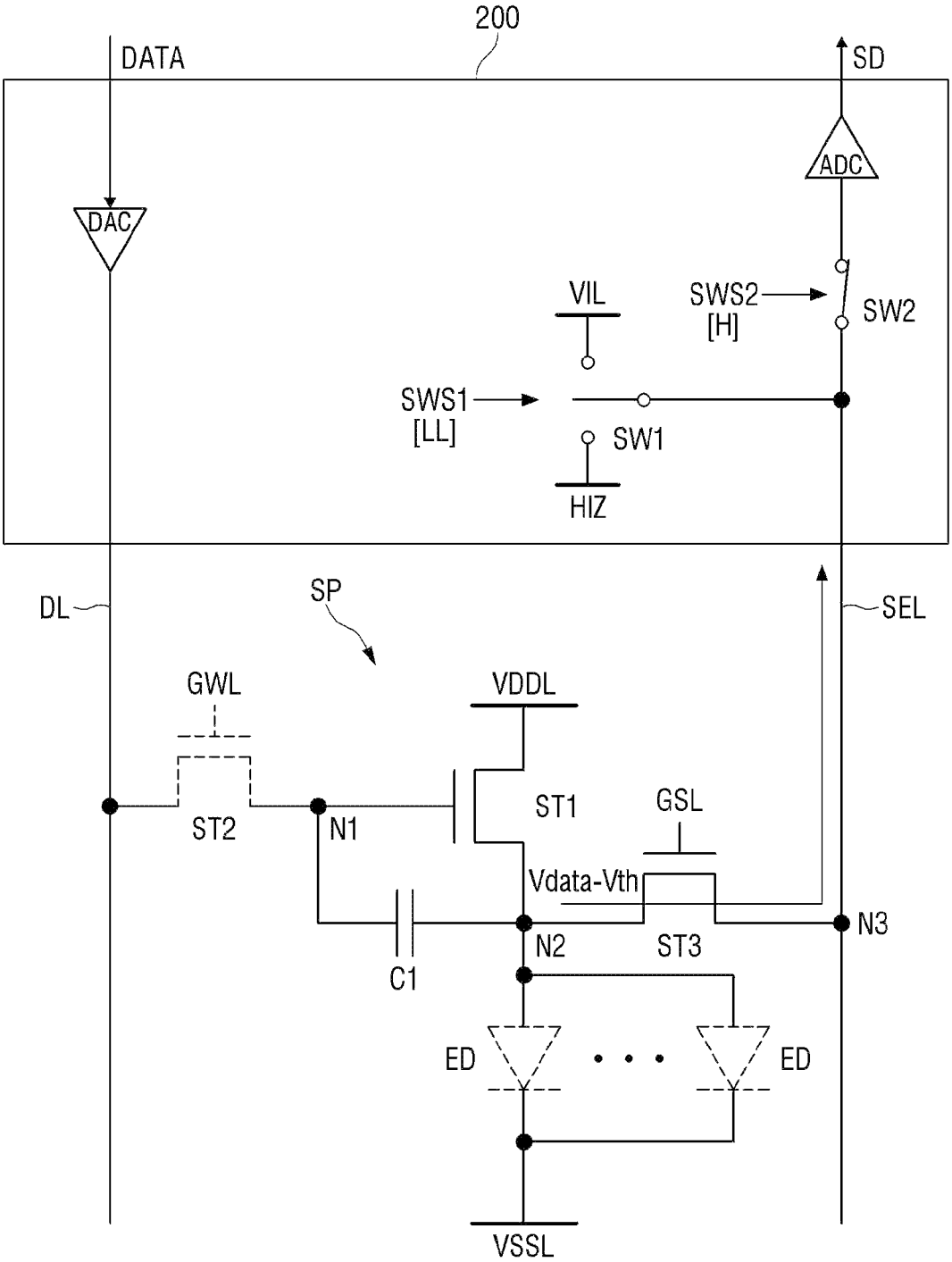
FIG. 15 is a schematic diagram of an equivalent circuit illustrating an operation of a pixel during a fourth period of FIG. 11 in a display device according to another embodiment.

FIG. 15 is a schematic diagram of an equivalent circuit illustrating an operation of a pixel during a fourth period of FIG. 11 in a display device according to another embodiment.

Referring to FIG. 15 in conjunction with FIG. 11, the pixel SP may receive the first gate signal GW of a low level (or gate-off voltage) and the second gate signal GS of a high level (or gate-on voltage) during the fourth period t4 of the sensing period SEN. The second transistor ST2 may be turned off during the fourth period t4. The first switching element SW1 may be turned off by receiving the first switching signal SW having a bit value of [LL] during the fourth period t4. The second switching element SW2 may receive the second switching signal SWS2 of a high level during the fourth period t4 and may electrically connect the analog-to-digital converter ADC to the third node N3, which is the sensing line SEL. A gate-source voltage Vgs (Vgs=Vdata−Vint) of the first transistor ST1 may be greater than a threshold voltage Vth of the first transistor ST1 during the fourth period t4 (Vgs>Vth), and the first transistor ST1 may be turned on until the gate-source voltage Vgs of the first transistor ST1 reaches the threshold voltage Vth of the first transistor ST1. Accordingly, the voltage of the second node N2, which is the source electrode of the first transistor ST1, may rise to "Vdata−Vth," and the threshold voltage Vth of the first transistor ST1 may be sampled at the second node N2. The third transistor ST3 may be turned on during the fourth period t4, and the voltage of the second node N2 may be sensed as a sensing signal through the sensing line SEL.

Figure 16:
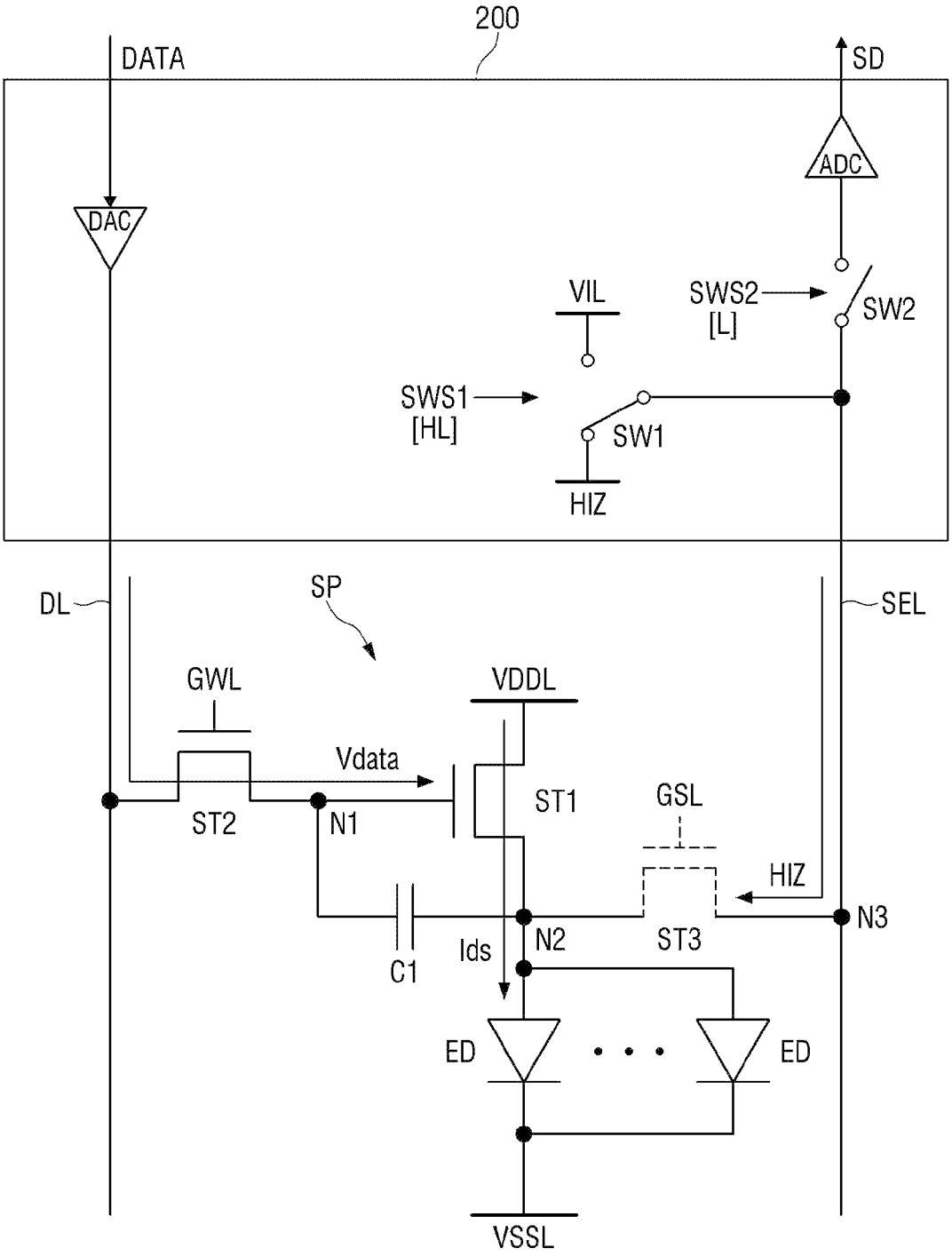
FIG. 16 is a schematic diagram of an equivalent circuit illustrating an operation of a pixel during a fifth period of FIG. 11 in a display device according to another embodiment.

FIG. 16 is a schematic diagram of an equivalent circuit illustrating an operation of a pixel during a fifth period of FIG. 11 in a display device according to another embodiment.

Referring to FIG. 16 in conjunction with FIG. 11, the pixel SP may receive the first gate signal GW of a high level (or gate-on voltage) and the second gate signal GS of a high level during the fifth period t5 of the active period ACT. The data line DL may supply the data voltage Vdata generated based on the second digital video data DATA2 to the pixel SP during the fifth period t5. The second transistor ST2 may be turned on during the fifth period t5 to supply the data voltage Vdata to the first node N1, which is the gate electrode of the first transistor ST1. The first switching element SW1 may receive the first switching signal SWS1 having a bit value of [HL] during the fifth period t5, and may electrically connect the high impedance HIZ to the third node N3, which is the sensing line SEL. The gate electrode of the third transistor ST3 may receive the second gate signal GS of a high level, but the source electrode of the third transistor ST3 may be electrically connected to the high impedance HIZ, so that the gate-source voltage Vgs of the third transistor ST3 may be smaller than the threshold voltage Vth of the third transistor ST3 (Vgs<Vth). The third transistor ST3 may be turned off during the fifth period t5 or the data addressing period of each of the third and fourth frame periods FR3 and FR4, and the voltage of the second node N2 may be stably maintained. In case that the digital video data DATA is not changed, the first electrode of the light emitting element ED may not receive the initialization voltage Vint during the data addressing period, so that the display device 10 may not have the luminance valley LV, and the luminance may not be reset. Accordingly, since the display device 10 does not have the luminance valley LV in case that the frequency variable driving is performed without changing the digital video data DATA, luminance degradation during the data addressing period may be reduced minimized, and luminance differences between driving frequencies may be improved. As a result, the display device 10 may improve image quality in variable refresh rate (VRR) driving.

The pixel SP may receive the first gate signal GW of a low level and the second gate signal GS of a low level during the sixth period t6 of the active period ACT. The second and third transistors ST2 and ST3 may be turned off during the sixth period t6.

The first transistor ST1 may be turned on by the voltage difference between the gate electrode and the source electrode or the voltage difference between the first node N1 and the second node N2 during the sixth period t6. A drain-source current Ids (or driving current) of the first transistor ST1 may be supplied to the light emitting elements ED based on the gate-source voltage of the first transistor ST1. Accordingly, the light emitting elements ED may emit light during the sixth period t6.

Figure 17:
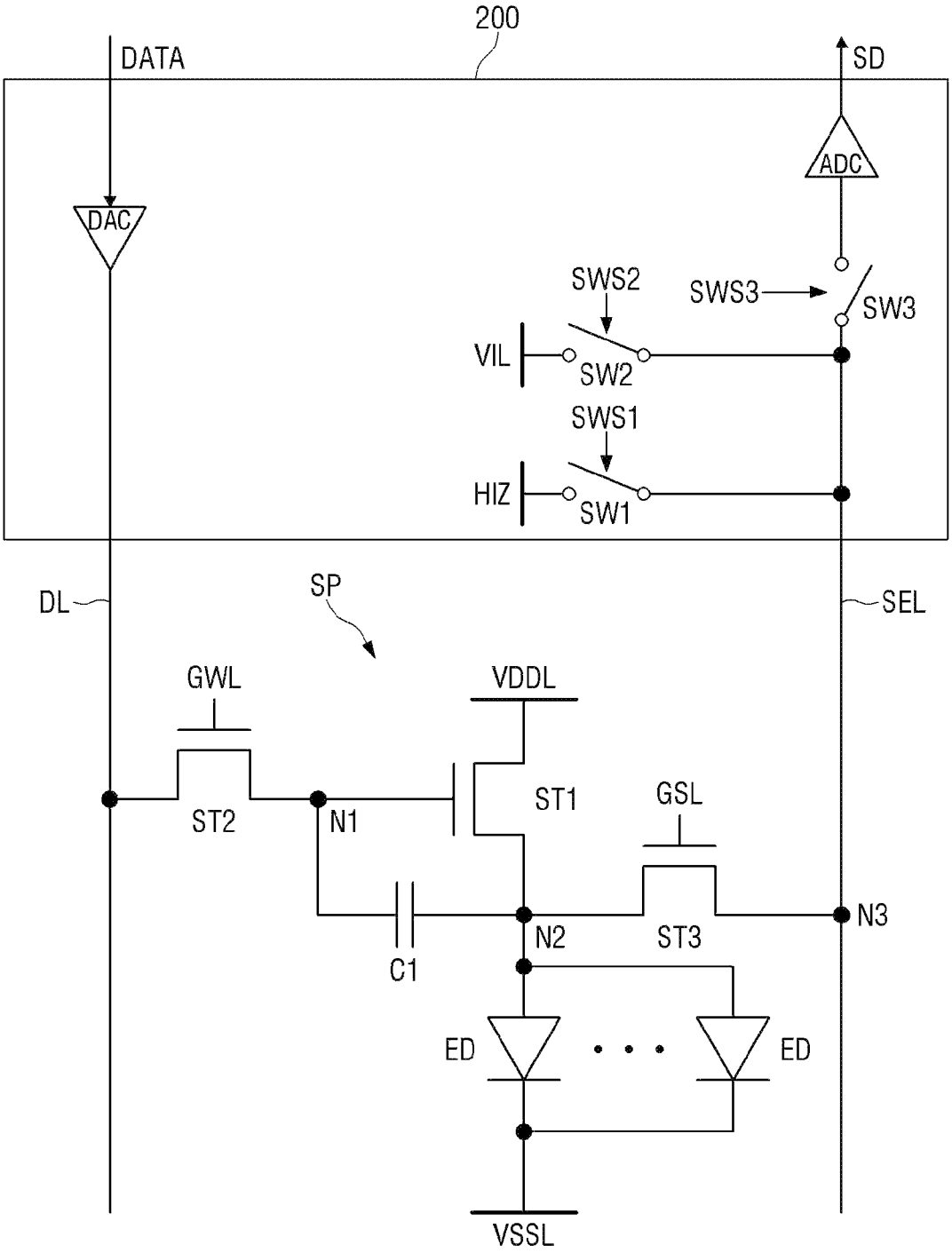
FIG. 17 is a schematic diagram of an equivalent circuit illustrating a data driver and a pixel of a display device according to still another embodiment.

FIG. 17 is a schematic diagram of an equivalent circuit illustrating a data driver and a pixel of a display device according to still another embodiment. The display device of FIG. 17 is different from the display device of FIG. 10 at least in the configurations of the first to third switch elements SW1, SW2, and SW3, and repetitive descriptions may be simplified or omitted.

Referring to FIG. 17, each of the pixels SP may be electrically connected to the first gate line GWL, the second gate line GSL, the data line DL, the sensing line SEL, a driving voltage line VDDL, and a low-potential line VSSL. The pixel SP may include first to third transistors ST1, ST2, and ST3, a first capacitor C1, and light emitting elements ED.

The data driver 200 may include the first switching element SW1, the second switching element SW2, the third switching element SW3, the analog-to-digital converter ADC, and the digital-to-analog converter DAC.

The first switching element SW1 may electrically connect the sensing line SEL to the high impedance HIZ based on the first switching signal SWS1. In case that the sensing line SEL is electrically connected to the high impedance HIZ and floats, it is possible to prevent the voltage of the second node N2 from falling although a second gate signal of a high level is applied to the third transistor ST3.

The second switching element SW2 may electrically connect the sensing line SEL to the initialization voltage line VIL based on the second switching signal SWS2. In case that the initialization voltage line VIL is electrically connected to the sensing line SEL, the initialization voltage line VIL may supply the initialization voltage Vint to the sensing line SEL.

A third switching element SW3 may electrically connect the sensing line SEL to the analog-to-digital converter ADC based on a third switching signal SWS3. In case that the analog-to-digital converter ADC is electrically connected to the sensing line SEL, the sensing line SEL may supply a sensing signal to the analog-to-digital converter ADC, and the analog-to-digital converter ADC may convert the sensing signal to digital data to generate the sensing data SD. The analog-to-digital converter ADC may supply the sensing data SD to a compensation circuit (not illustrated) of the timing controller 300.

The digital-to-analog converter DAC may receive the digital video data DATA from the compensation circuit of the timing controller 300. The digital video data DATA may reflect the sensing data SD. The digital-to-analog converter DAC may convert the digital video data DATA into analog data to generate a data voltage Vdata. The digital-to-analog converter DAC may supply the data voltage Vdata to the data line DL.

Figure 18:
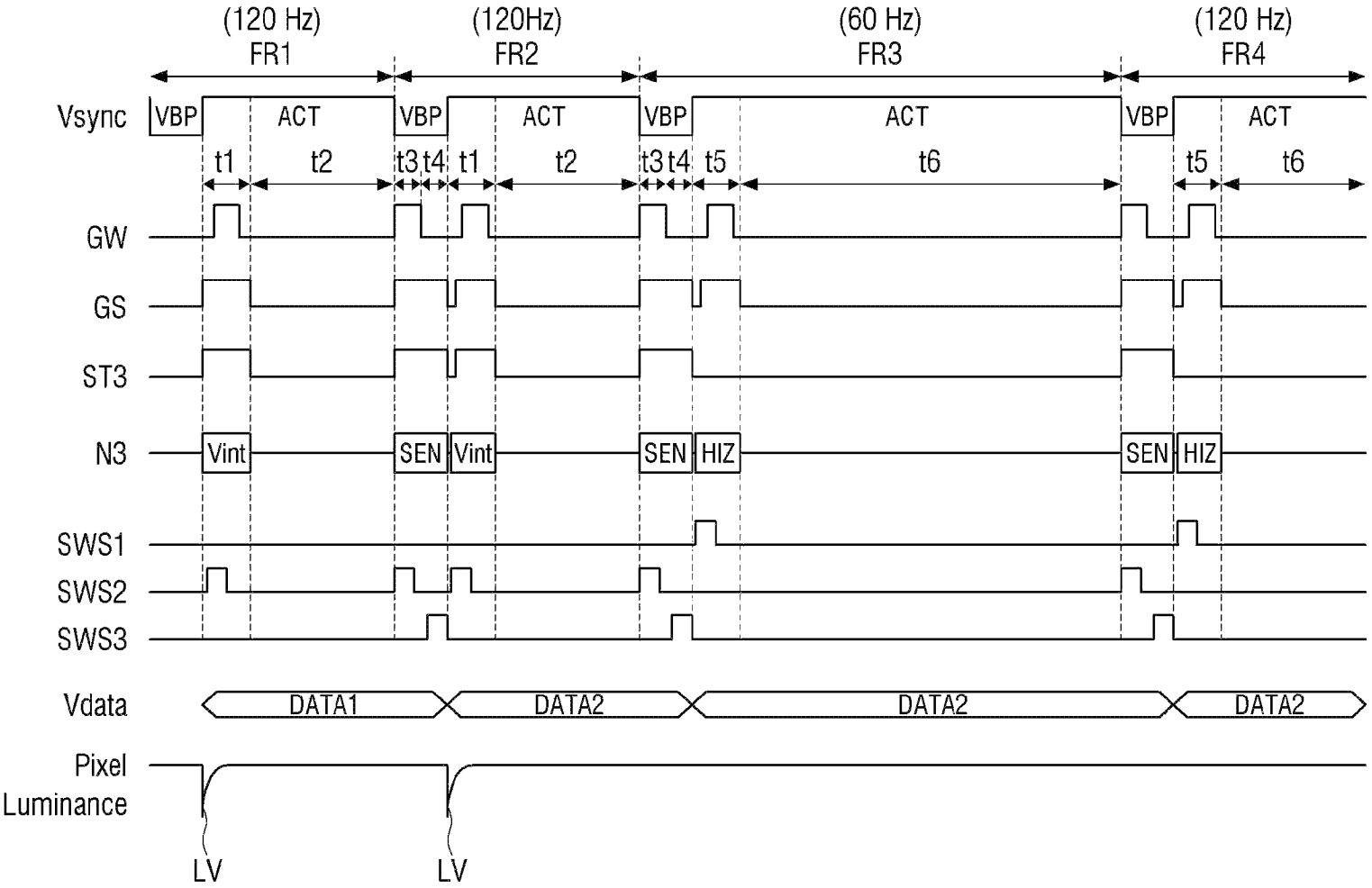
FIG. 18 is a schematic timing diagram illustrating signals and voltages of a display device according to still another embodiment.

FIG. 18 is a schematic timing diagram illustrating signals and voltages of a display device according to still another embodiment. The timing diagram of FIG. 18 is different from the timing diagram of FIG. 11 at least in the configuration of the first to third switching signals SWS1, SWS2, and SWS3, and repetitive descriptions may be simplified or omitted.

Referring to FIG. 18, the display device may be driven at a driving frequency of about 120 Hz during first and second frame periods FR1 and FR2, may be changed to a driving frequency of about 60 Hz during a third frame period FR3, and may be changed back to a driving frequency of about 120 Hz during a fourth frame period FR4. For example, the length of the third frame period FR3 may be twice the length of each of the first, second, and fourth frame periods FR1, FR2, and FR4.

A first period t1 of the first and second frame periods FR1 and FR2 and a fifth period t5 of the third frame period FR3 may be data addressing periods for supplying data voltages to the pixels SP. A second period t2 of the first and second frame periods FR1 and FR2 and a sixth period t6 of the third frame period FR3 may be blank periods in which data voltages are not supplied to the pixels SP.

In case that the digital video data DATA is changed, the display device 10 may supply the data voltage Vdata to the second transistor ST2 of the pixels SP in the data addressing period, and may supply the initialization voltage Vint to the third transistor ST3 of the pixels SP. The display device 10 may supply the data voltage Vdata and the initialization voltage Vint to the pixels SP during the first period t1 of each of the first and second frame periods FR1 and FR2. In case that the initialization voltage Vint is supplied to the pixels SP, the pixels SP may have a luminance valley LV.

In case that the digital video data DATA is not changed, the display device 10 may supply the data voltage Vdata to the second transistors ST2 of the pixels SP in the data addressing period, and may electrically connect the third node N3, which is the sensing line SEL, to the high impedance HIZ. The display device 10 may electrically connect the third node N3, which is the sensing line SEL, to the high impedance HIZ during the fifth period t5 of the third frame period FR3 and the fifth period t5 of the fourth frame period FR4. In this case, the gate electrode of the third transistor ST3 may receive the second gate signal GS of a high level, but the source electrode of the third transistor ST3 may be electrically connected to the high impedance HIZ, so that the gate-source voltage Vgs of the third transistor ST3 may be smaller than the threshold voltage Vth of the third transistor ST3 (Vgs<Vth). The third transistor ST3 may be turned off during the fifth period t5 or the data addressing period of each of the third and fourth frame periods FR3 and FR4, and the voltage of the second node N2 may be stably maintained. In case that the digital video data DATA is not changed, the first electrode of the light emitting element ED may not receive the initialization voltage Vint during the data addressing period, so that the display device 10 may not have the luminance valley LV, and the luminance may not be reset. Accordingly, since the display device 10 does not have the luminance valley LV in case that the frequency variable driving is performed without changing the digital video data DATA, luminance degradation during the data addressing period may be minimized, and luminance differences between driving frequencies may be improved. As a result, the display device 10 may improve image quality in variable refresh rate (VRR) driving.

Figure 19:
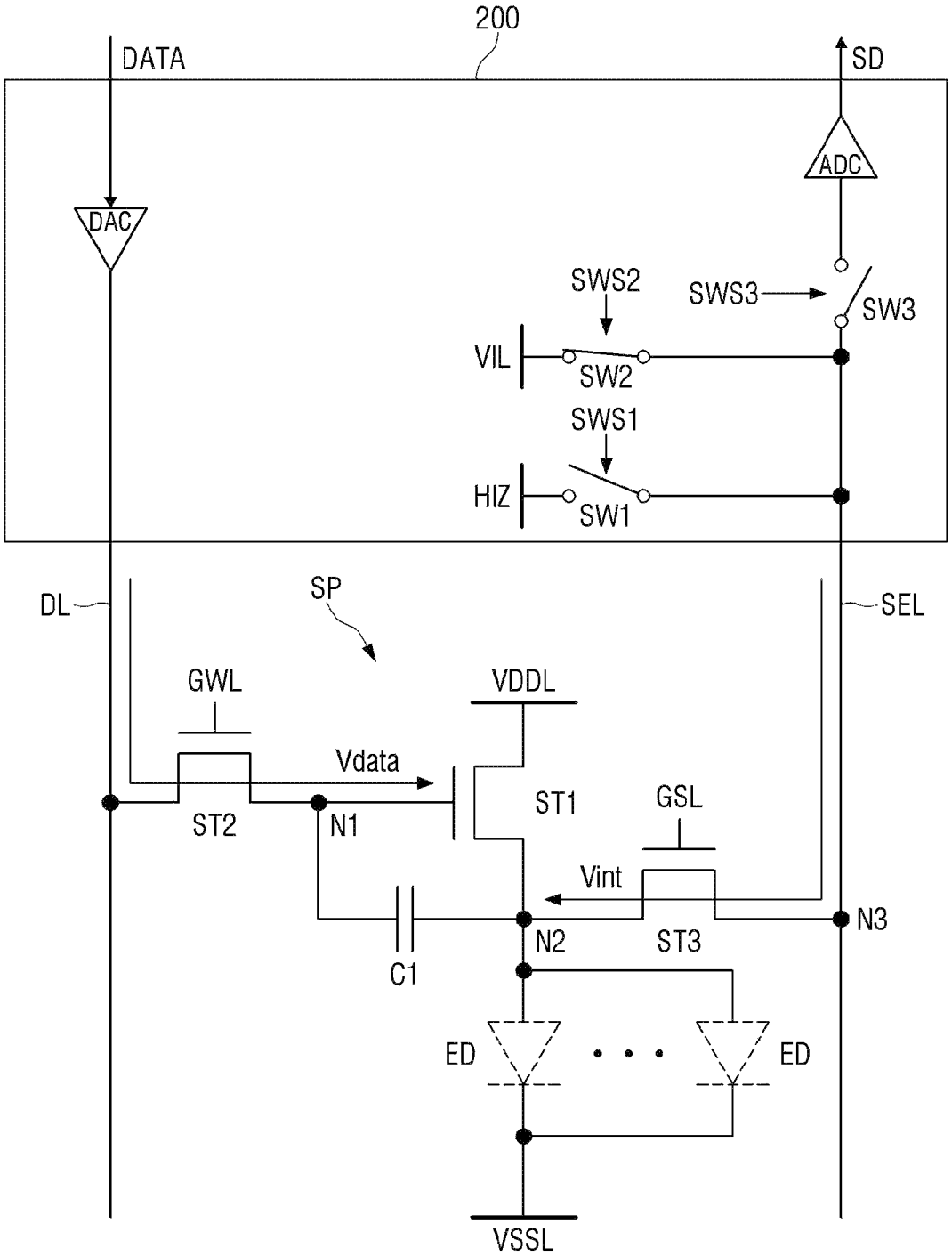
FIG. 19 is a schematic diagram of an equivalent circuit illustrating an operation of a pixel during a first period of FIG. 18 in a display device according to still another embodiment.

FIG. 19 is a schematic diagram of an equivalent circuit illustrating an operation of a pixel during a first period of FIG. 18 in a display device according to still another embodiment.

Referring to FIG. 19 in conjunction with FIG. 18, the pixel SP may receive the first gate signal GW of a high level and the second gate signal GS of a high level during the first period t1 of the active period ACT. The data line DL may supply the data voltage Vdata generated based on the first digital video data DATA1 to the pixel SP during the first period t1 of the first frame period FR1. The second transistor ST2 may be turned on during the first period t1 to supply the data voltage Vdata to the first node N1, which is the gate electrode of the first transistor ST1. The second switching element SW2 may receive the second switching signal SWS2 of a high level during the first period t1, and may electrically connect the initialization voltage line VIL to the third node N3, which is the sensing line SEL. The initialization voltage line VIL may supply the initialization voltage Vint to the third node N3 during the first period t1. The third transistor ST3 may be turned on during the first period t1 to supply the initialization voltage Vint to the second node N2, which is the source electrode of the first transistor ST1.

Figure 20:
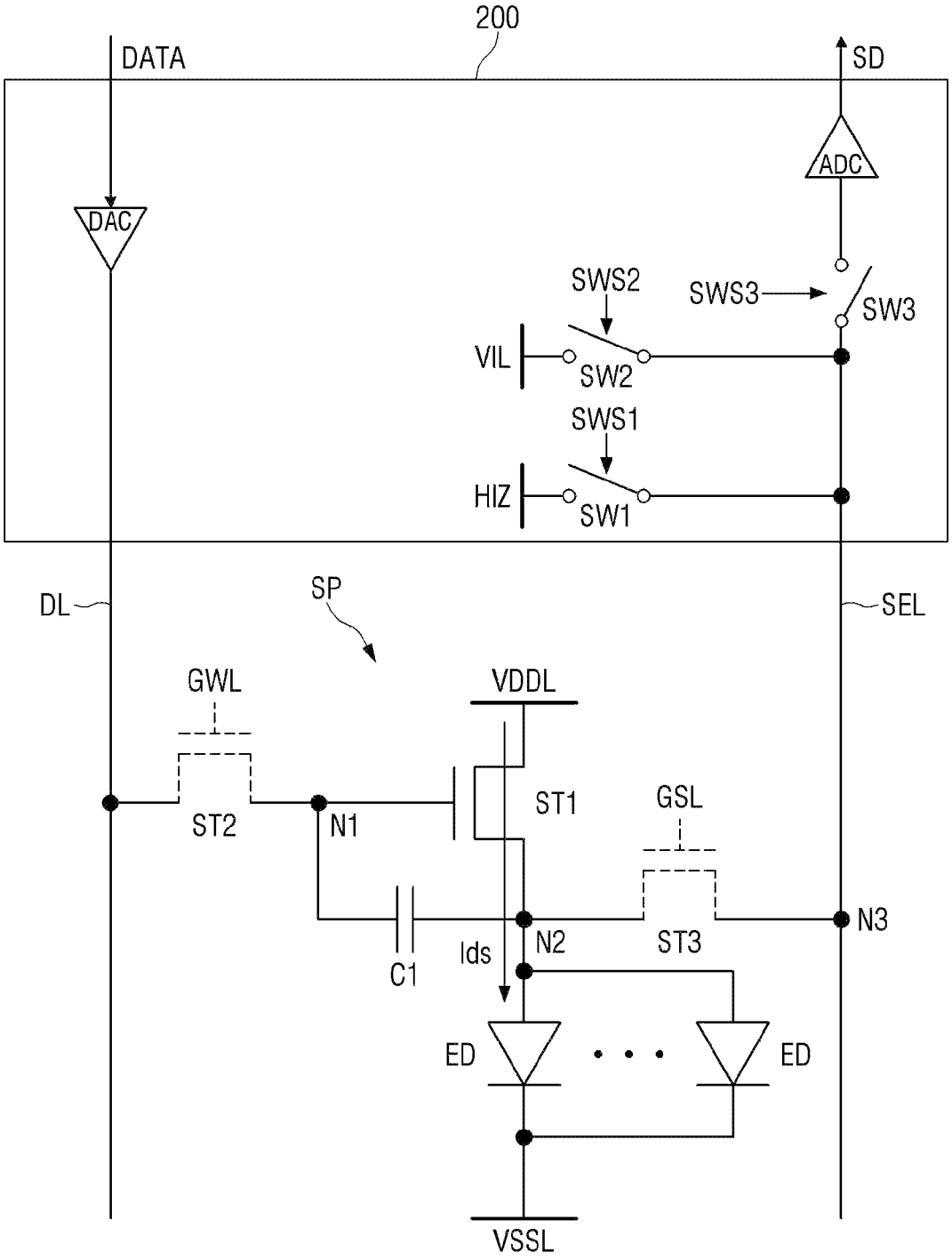
FIG. 20 is a schematic diagram of an equivalent circuit illustrating an operation of a pixel during a second period of FIG. 18 in a display device according to still another embodiment.

FIG. 20 is a schematic diagram of an equivalent circuit illustrating an operation of a pixel during a second period of FIG. 18 in a display device according to still another embodiment.

Referring to FIG. 20 in conjunction with FIG. 18, the pixel SP may receive the first gate signal GW of a low level and the second gate signal GS of a low level during the second period t2 of the active period ACT. The second and third transistors ST2 and ST3 may be turned off during the second period t2.

The first transistor ST1 may be turned on by the voltage difference between the gate electrode and the source electrode or the voltage difference between the first node N1 and the second node N2 during the second period t2. The first to third switching elements SW1, SW2, and SW3 may be turned off during the second period t2. A drain-source current Ids (or driving current) of the first transistor ST1 may be supplied to the light emitting elements ED based on the gate-source voltage of the first transistor ST1. Accordingly, the light emitting elements ED may emit light during the second period t2.

Figure 21:
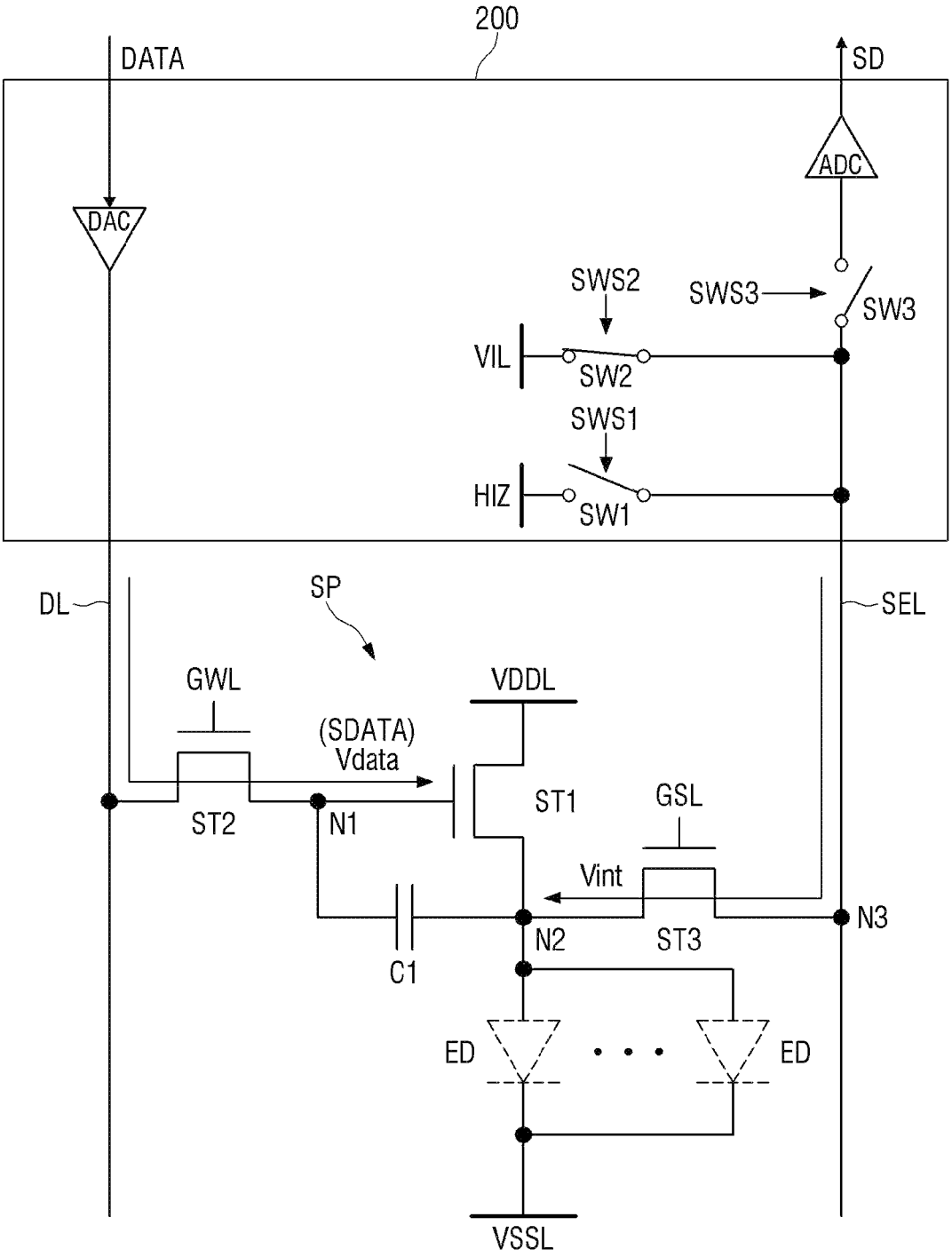
FIG. 21 is a schematic diagram of an equivalent circuit illustrating an operation of a pixel during a third period of FIG. 18 in a display device according to still another embodiment.

FIG. 21 is a schematic diagram of an equivalent circuit illustrating an operation of a pixel during a third period of FIG. 18 in a display device according to still another embodiment.

Referring to FIG. 21 in conjunction with FIG. 18, the pixels SP disposed in some rows among the pixels SP may be sensed by the data driver 200 during the sensing period SEN.

The pixel SP may receive the first gate signal GW of a high level and the second gate signal GS of a high level during the third period t3 of the sensing period SEN. The data line DL may supply the data voltage Vdata corresponding to sensing data SDATA to the pixel SP during the third period t3. The second transistor ST2 may be turned on during the third period t3 to supply the data voltage Vdata to the first node N1, which is the gate electrode of the first transistor ST1. The second switching element SW2 may receive the second switching signal SWS2 of a high level during the first period t1, and may electrically connect the initialization voltage line VIL to the third node N3, which is the sensing line SEL. The initialization voltage line VIL may supply the initialization voltage Vint to the third node N3 during the third period t3. The third transistor ST3 may be turned on during the third period t3 to supply the initialization voltage Vint to the second node N2, which is the source electrode of the first transistor ST1.

Figure 22:
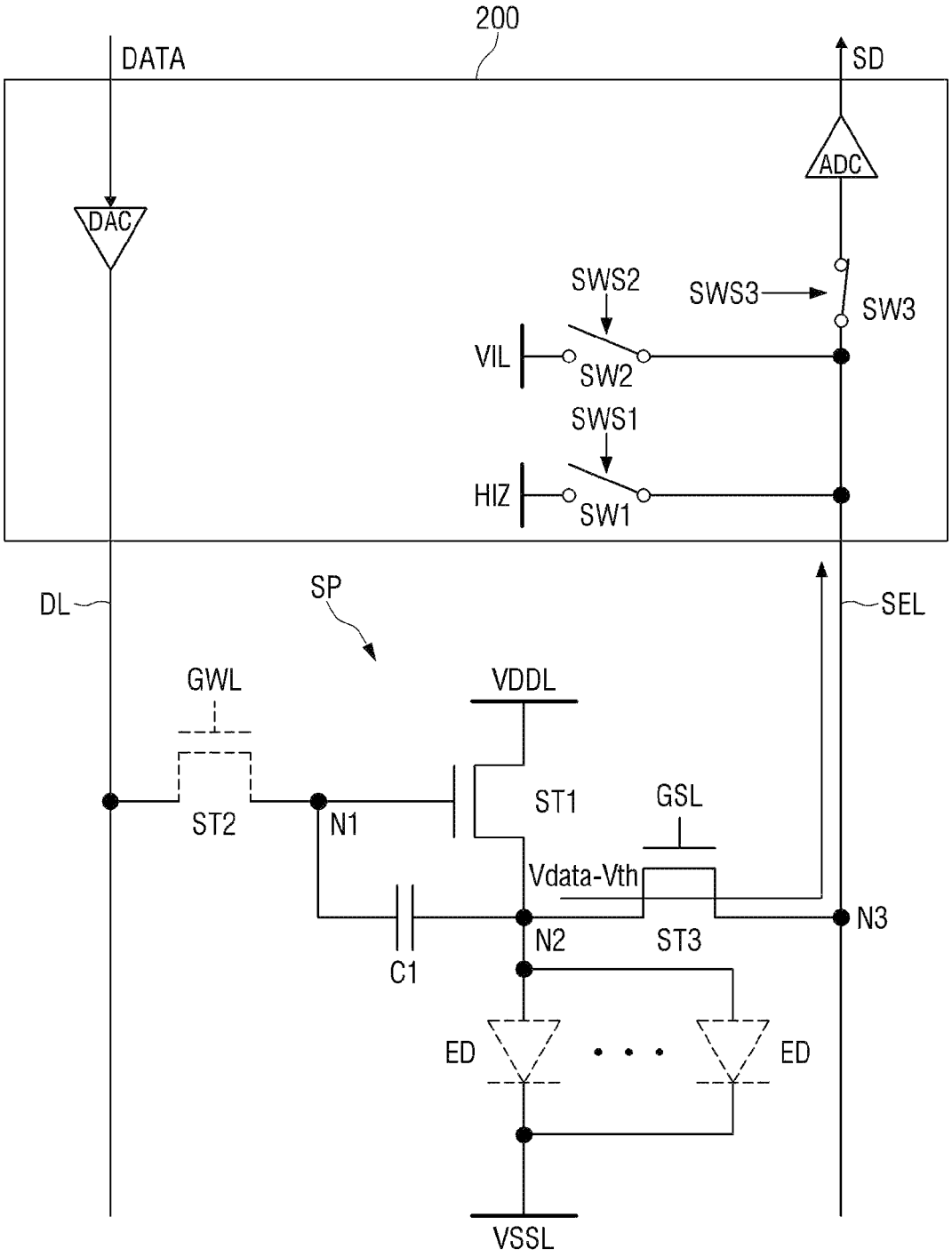
FIG. 22 is a schematic diagram of an equivalent circuit illustrating an operation of a pixel during a fourth period of FIG. 18 in a display device according to still another embodiment.

FIG. 22 is a schematic diagram of an equivalent circuit illustrating an operation of a pixel during a fourth period of FIG. 18 in a display device according to still another embodiment.

Referring to FIG. 22 in conjunction with FIG. 18, the pixel SP may receive the first gate signal GW of a low level and the second gate signal GS of a high level during the fourth period t4 of the sensing period SEN. The second transistor ST2 may be turned off during the fourth period t4. The third switching element SW3 may receive the third switching signal SWS3 of a high level during the fourth period t4, and may electrically connect the analog-to-digital converter ADC to the third node N3, which is the sensing line SEL. The third transistor ST3 may be turned on during the fourth period t4, and the voltage of the second node N2 may be sensed as a sensing signal through the sensing line SEL.

Figure 23:
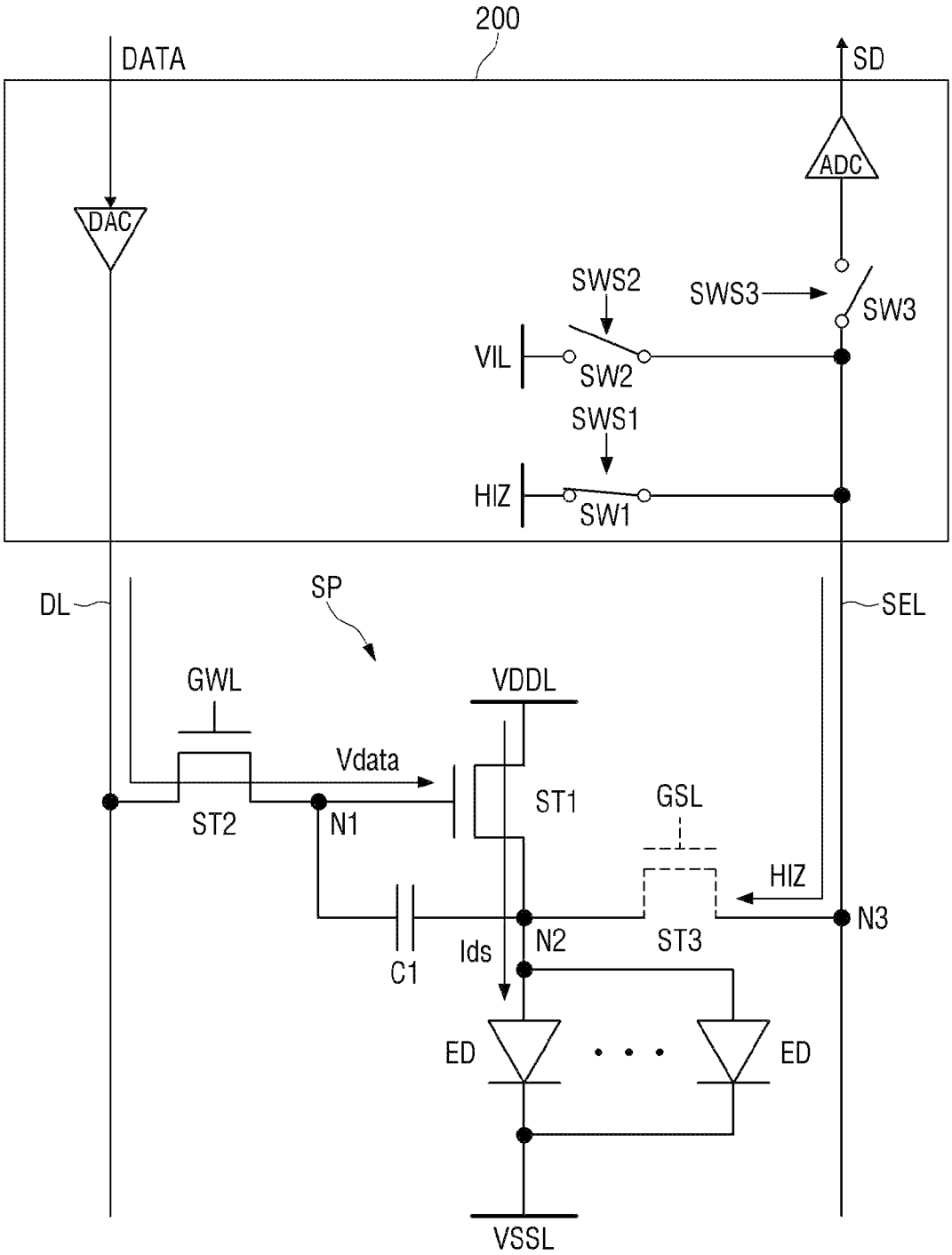
FIG. 23 is a schematic diagram of an equivalent circuit illustrating an operation of a pixel during a fifth period of FIG. 18 in a display device according to still another embodiment.

FIG. 23 is a schematic diagram of an equivalent circuit illustrating an operation of a pixel during a fifth period of FIG. 18 in a display device according to still another embodiment.

Referring to FIG. 23 in conjunction with FIG. 18, the pixel SP may receive the first gate signal GW of a high level and the second gate signal GS of a high level during the fifth period t5 of the active period ACT. The data line DL may supply the data voltage Vdata generated based on the second digital video data DATA2 to the pixel SP during the fifth period t5. The second transistor ST2 may be turned on during the fifth period t5 to supply the data voltage Vdata to the first node N1, which is the gate electrode of the first transistor ST1. The first switching element SW1 may receive the first switching signal SWS1 of a high level during the fifth period t5, and may electrically connect the high impedance HIZ to the third node N3, which is the sensing line SEL. The gate electrode of the third transistor ST3 may receive the second gate signal GS of a high level, but the source electrode of the third transistor ST3 may be electrically connected to the high impedance HIZ, so that the gate-source voltage Vgs of the third transistor ST3 may be smaller than the threshold voltage Vth of the third transistor ST3 (Vgs<Vth). The third transistor ST3 may be turned off during the fifth period t5 or the data addressing period of each of the third and fourth frame periods FR3 and FR4, and the voltage of the second node N2 may be stably maintained. In case that the digital video data DATA is not changed, the first electrode of the light emitting element ED may not receive the initialization voltage Vint during the data addressing period, so that the display device 10 may not have the luminance valley LV, and the luminance may not be reset. Accordingly, since the display device 10 does not have the luminance valley LV in case that the frequency variable driving is performed without changing the digital video data DATA, luminance degradation during the data addressing period may be minimized, and luminance differences between driving frequencies may be improved. As a result, the display device 10 may improve image quality in variable refresh rate (VRR) driving.

What is claimed is:

1. A display device comprising:

a display panel including a pixel including a light emitting element emitting light and electrically connected to a data line and a sensing line;

a timing controller varying a driving frequency of the display panel based on an input frequency of digital video data; and a data driver supplying a data voltage to the data line based on the digital video data during a data addressing period of a frame period and receiving a sensing signal from the sensing line during a sensing period, wherein the data driver electrically connects the sensing line to an initialization voltage line during the data addressing period in case that the digital video data is changed, and electrically connects the sensing line to a high impedance during the data addressing period in case that the digital video data is not changed.

2. The display device of claim 1, wherein the pixel emits light during a blanking period immediately after the data addressing period of the frame period, and a length of the data addressing period is maintained and a length of the blanking period is changed in case that the driving frequency is changed.

3. The display device of claim 2, wherein the data driver drives the pixel during a first frame period of being driven at a first driving frequency and a second frame period of being driven at a second driving frequency, the second driving frequency is smaller than the first driving frequency, and a length of a blanking period of the first frame period is shorter than a length of a blanking period of the second frame period.

4. The display device of claim 1, wherein the pixel comprises:

a first transistor disposed between a driving voltage line and the light emitting element and supplying a driving current to the light emitting element;

a second transistor electrically connecting the data line to a first node that is a gate electrode of the first transistor based on a first gate signal; and a third transistor electrically connecting the sensing line to a second node that is a source electrode of the first transistor based on a second gate signal.

5. The display device of claim 4, wherein the data driver supplies a data voltage to the second transistor during the data addressing period.

6. The display device of claim 4, wherein the third transistor is turned off during the data addressing period in case that the digital video data is not changed.

7. The display device of claim 6, wherein a gate electrode of the third transistor receives a second gate signal of a gate-on voltage during the data addressing period in case that the digital video data is not changed, and a source electrode of the third transistor is electrically connected to a high impedance through the sensing line.

8. The display device of claim 1, wherein the data driver comprises:

an analog-to-digital converter converting the sensing signal into digital data;

a first switching element electrically connecting the sensing line to the high impedance or the initialization voltage line based on a first switching signal; and a second switching element electrically connecting the sensing line to the analog-to-digital converter based on a second switching signal.

9. The display device of claim 8, wherein the timing controller supplies a first switching signal having a bit value to electrically connect the sensing line to the initialization voltage line, to the first switching element during the data addressing period in case that the digital video data is changed.

10. The display device of claim 8, wherein the timing controller supplies a first switching signal having a bit value to connect the sensing line to the high impedance, to the first switching element during the data addressing period in case that the digital video data is not changed.

11. The display device of claim 1, wherein the data driver comprises:

an analog-to-digital converter converting the sensing signal into digital data;

a first switching element electrically connecting the sensing line to the high impedance based on a first switching signal;

a second switching element electrically connecting the sensing line to the initialization voltage line based on a second switching signal; and a third switching element electrically connecting the sensing line to the analog-to-digital converter based on a third switching signal.

12. The display device of claim 11, wherein the timing controller supplies a first switching signal of a high level to the first switching element during the data addressing period in case that the digital video data is not changed.

13. The display device of claim 11, wherein the timing controller supplies a second switching signal of a high level to the second switching element during the data addressing period in case that the digital video data is changed.

14. A display device comprising:

a display panel including a pixel including a light emitting element emitting light and electrically connected to a data line and a sensing line;

a timing controller varying a driving frequency of the display panel based on an input frequency of digital video data; and a data driver supplying a data voltage to the data line based on the digital video data and receiving a sensing signal from the sensing line, wherein the pixel comprises:

a first transistor disposed between a driving voltage line and the light emitting element and supplying a driving current to the light emitting element;

a second transistor electrically connecting the data line to a first node that is a gate electrode of the first transistor based on a first gate signal; and a third transistor electrically connecting a second node that is a source electrode of the first transistor to a third node that is the sensing line based on a second gate signal, and the data driver electrically connects the sensing line to an initialization voltage line in case that the digital video data is changed, and electrically connects a high impedance to the third node in case that the digital video data is not changed.

15. The display device of claim 14, wherein the data driver supplies a data voltage to the second transistor during a data addressing period of a frame period, and the third transistor is turned off during the data addressing period in case that the digital video data is not changed.

16. The display device of claim 15, wherein a gate electrode of the third transistor receives a second gate signal of a gate-on voltage during the data addressing period in case that the digital video data is not changed, and a source electrode of the third transistor is electrically connected to a high impedance through the sensing line.

17. The display device of claim 14, wherein the data driver comprises:

an analog-to-digital converter converting the sensing signal into digital data;

a first switching element electrically connecting the sensing line to the high impedance or the initialization voltage line based on a first switching signal; and a second switching element electrically connecting the sensing line to the analog-to-digital converter based on a second switching signal.

18. The display device of claim 17, wherein the timing controller supplies a first switching signal having a bit value to electrically connect the sensing line to the initialization voltage line, to the first switching element in case that the digital video data is changed, and the timing controller supplies a first switching signal having a bit value to electrically connect the sensing line to the high impedance to the first switching element in case that the digital video data is not changed.

19. The display device of claim 14, wherein the data driver comprises:

an analog-to-digital converter converting the sensing signal into digital data;

a first switching element electrically connecting the sensing line to the high impedance based on a first switching signal;

a second switching element electrically connecting the sensing line to the initialization voltage line based on a second switching signal; and a third switching element electrically connecting the sensing line to the analog-to-digital converter based on a third switching signal.

20. The display device of claim 19, wherein the timing controller supplies a first switching signal of a high level to the first switching element in case that the digital video data is not changed, and the timing controller supplies a second switching signal of a high level to the second switching element in case that the digital video data is changed.

* * * * *